US011796276B2

(12) United States Patent
Chen

(10) Patent No.: US 11,796,276 B2
(45) Date of Patent: Oct. 24, 2023

(54) GUN

(71) Applicant: Po-Chih Chen, Taipei (TW)

(72) Inventor: Po-Chih Chen, Taipei (TW)

( * ) Notice: Subject to any disclaimer, the term of this patent is extended or adjusted under 35 U.S.C. 154(b) by 0 days.

(21) Appl. No.: 17/870,369

(22) Filed: Jul. 21, 2022

(65) Prior Publication Data

US 2023/0025379 A1 Jan. 26, 2023

(30) Foreign Application Priority Data

Jul. 26, 2021 (TW) ..... 110127313

(51) Int. Cl.
*F41A 33/06* (2006.01)
*F41A 19/10* (2006.01)
*F41A 3/72* (2006.01)

(52) U.S. Cl.
CPC ..... *F41A 33/06* (2013.01); *F41A 3/72* (2013.01); *F41A 19/10* (2013.01)

(58) Field of Classification Search
CPC .. F41A 3/78; F41A 19/10; F41A 19/12; F41A 19/34; F41A 3/54; F41C 3/00
See application file for complete search history.

(56) References Cited

U.S. PATENT DOCUMENTS 3,611,873 A * 10/1971 Ellison ..... F41A 3/62 D22/104
11,402,165 B1 * 8/2022 Besselink ..... F41A 5/04
2012/0085010 A1 * 4/2012 Cook ..... F41A 17/36 42/75.02
2021/0262746 A1 * 8/2021 Ellis ..... F41A 3/86

* cited by examiner

*Primary Examiner* — J. Woodrow Eldred
(74) *Attorney, Agent, or Firm* — Muncy, Geissler, Olds & Lowe, P.C.

(57) ABSTRACT

A gun includes a receiver assembly, a magazine, a trigger assembly, a sear assembly, a blowback assembly and a reciprocating slide. When the trigger rotates, the first connecting member is capable of pulling the trigger slide to move linearly, and driving the second connecting member, the sear assembly and the force-storing slide to move linearly towards the same direction. Moreover, the force-storing slide compresses the blowback spring, and the blowback slide receives a restoring force of the blowback spring to drive the reciprocating slide to move backward. The gun could achieve a simulation effect of rotating actions of the trigger, as well as a simulation effect of blowback actions of the reciprocating slide.

20 Claims, 21 Drawing Sheets

GUN

BACKGROUND

Technology Field

The present disclosure relates to a gun, and more particularly, to a gun that blows back with a reciprocating slide.

Description of the Prior Art

With the fast-paced modern life, individuals are faced with stress from life, and accumulated pressure which needs to be relieved through various recreational activities. There are quite a few individuals that select more intense and exciting activities to relieve pressure. For example, a quite large number of shooting game lovers use toy guns to perform shooting sports so as to achieve the effect of pressure relief.

When it comes to choosing toy guns, shooting game (or survival game) lovers prefer to choose those with better simulation effects. Thus, apart from highlighting simulation of appearance and quality, some toy guns in the recent years further emphasize shooting effects of real guns. Moreover, in some overseas shooting trainings, it is necessary for toy guns to simulate realistic shooting effects so that one can quickly get accustomed to future practices of live ammunitions.

However, current toy guns yet lack many simulation mechanisms or actions. For example, triggers of some toy guns still act by sliding horizontally, and fail to achieve rotating actions as those triggers of real guns. Therefore, there is a need for an improvement.

SUMMARY

In view of the task above, it is a primary object of the present disclosure to provide a gun, which resolves, by using novel structures of a trigger assembly, a sear assembly and a blowback assembly and connections thereof, the issue of a simulation failure in respect of mechanisms and actions of conventional guns.

To achieve the above object, the present disclosure provides a gun including a receiver assembly, a magazine, a trigger assembly, a sear assembly, a blowback assembly and a reciprocating slide. The magazine is detachably installed on the receiver assembly. The trigger assembly is accommodated in the receiver assembly, and is located on a front side of the magazine. The trigger assembly includes a trigger, a trigger slide, a first connecting member and a second connecting member. The trigger pivots to the receiver assembly. Two opposite ends of the first connecting member connect to the trigger and the trigger slide, respectively. One end of the second connecting member connects to the trigger slide. The sear assembly is arranged in the receiver assembly, and is located on a rear side of the magazine. The sear assembly connects to the other end of the second connecting member. The blowback assembly includes a energy-storing slide, a blowback spring and a blowback slide. The energy-storing slide is engaged with the sear assembly. One end of the blowback spring close to the magazine abuts against the energy-storing slide. The energy-storing slide and the blowback spring are accommodated in the blowback slide. The reciprocating slide sleeves on the receiver assembly and connects with the blowback slide. With the above structure, when the trigger rotates toward a first direction, the first connecting member pulls the trigger slide to move linearly in the first direction, and the second connecting member, the sear assembly and the energy-storing slide sequentially move linearly in the first direction. Moreover, the energy-storing slide compresses the blowback spring, and the blowback slide receive a restoring energy of the blowback spring and drives the reciprocating slide to move in the first direction.

According to an embodiment of the present disclosure, the receiver assembly includes a receiver housing, a first body and a second body. The first body and the second body are accommodated in the receiver housing, the first body is located on a front side of the magazine, the second body is located on a rear side of the magazine, and the blowback assembly is located on an upper side of the second body.

To achieve the above object, the present disclosure provides a gun including a receiver assembly, a sear assembly, a trigger assembly, a reciprocating slide, a blowback assembly and a reset assembly. The receiver assembly includes a first body and a second body. The sear assembly is movably arranged on the second body. The trigger assembly is accommodated in the receiver assembly and is partially rotatable relative to the receiver assembly. The trigger assembly connects to the first body and the sear assembly. The reciprocating slide connects to the receiver assembly and is movable relative to the receiver assembly. The reset assembly is arranged on the first body and connects to the reciprocating slide. When the trigger assembly partially rotates relative to the receiver assembly, the sear assembly can be driven to move the blowback assembly, such that the blowback assembly can provide a force for the reciprocating slide to move towards a first direction, the reciprocating slide drives the reset assembly to move towards the first direction, and the reset assembly can provide a force for the reciprocating slide to move towards a second direction.

In continuation of the above description, a gun according to the present disclosure includes a receiver assembly, a magazine, a trigger assembly, a sear assembly, a blowback assembly and a reciprocating slide. The trigger assembly includes a trigger, a trigger slide, a first connecting member and a second connecting member. The blowback assembly includes a energy-storing slide, a blowback spring and a blowback slide. The energy-storing slide is engaged with the sear assembly. Two opposite ends of the first connecting member connect to the trigger and the trigger slide, respectively, and two opposite ends of the second connecting member connect to the trigger slide and the sear assembly, respectively. The sear assembly is further engaged with the energy-storing slide. When the trigger rotates, the first connecting member is capable of pulling the trigger slide to move linearly, and driving the second connecting member, the sear assembly and the energy-storing slide to move linearly towards the same direction. Moreover, the energy-storing slide compresses the blowback spring, and the blowback slide receives a restoring energy of the blowback spring to drive the reciprocating slide to move backward. Thus, the gun of the present disclosure achieves a simulation effect of rotating actions of a trigger, as well as a simulation effect of blowback actions of a reciprocating slide.

DETAILED DESCRIPTION OF THE EMBODIMENTS

Preferred specific embodiments are given below to better understand the technical contents of the present invention.

The above and other technical contents, features and effects of the present invention can be clearly presented in the detailed description of the preferred embodiments given with the accompanying drawings below. The directional and orientation terms used in the embodiments, such as up, down, left, right, in front or behind, and above, below, on the left, on the right, in the front (side or end) or in the rear (side or end), are merely directions of the reference accompanying drawings. Thus, these directional and orientation terms used are merely for description purposes and are not to be construed as limitations to the present invention.

Figure 1:
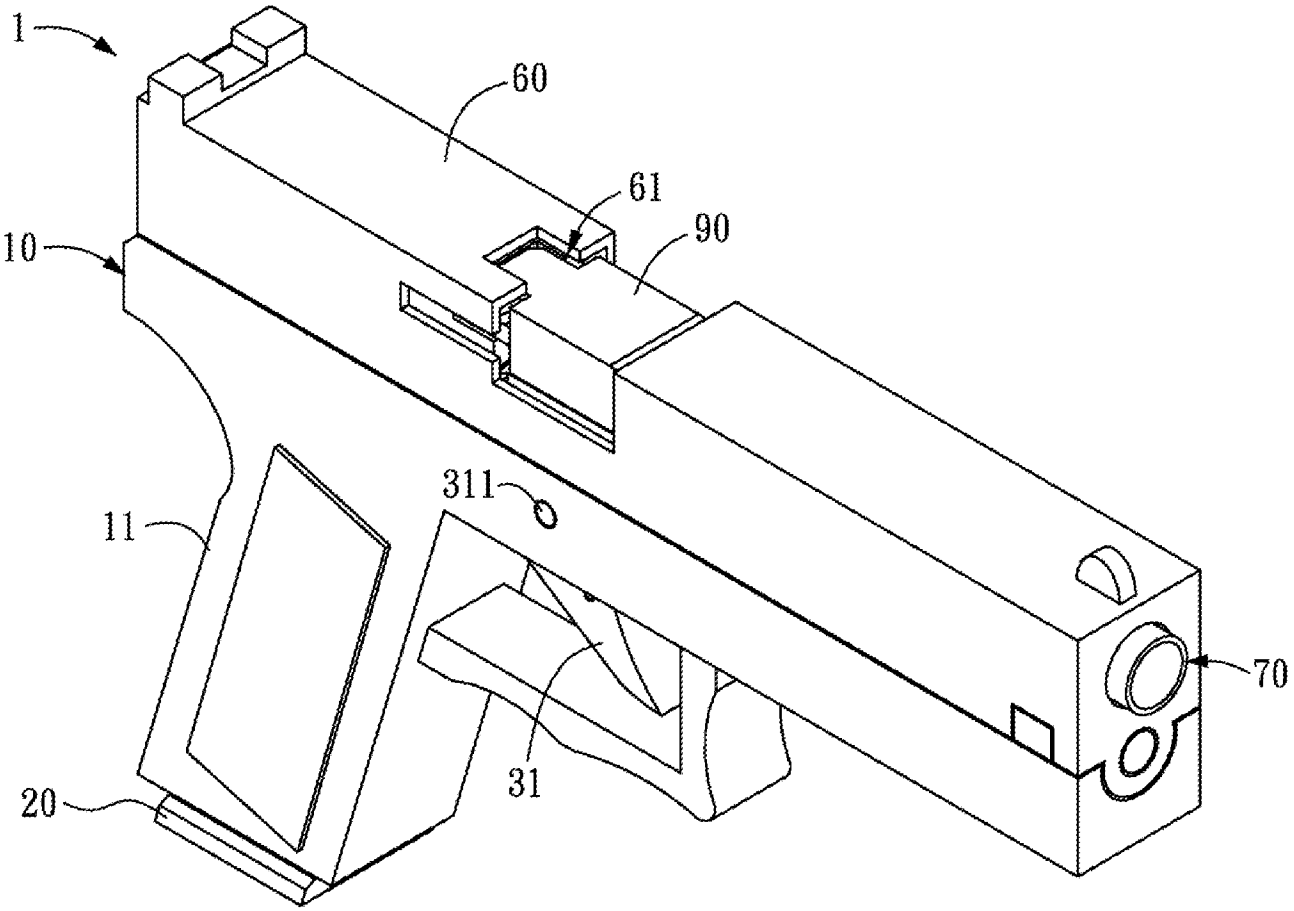
FIG. 1 is a schematic diagram of a toy gun according to an embodiment of the present invention.
Figure 2:
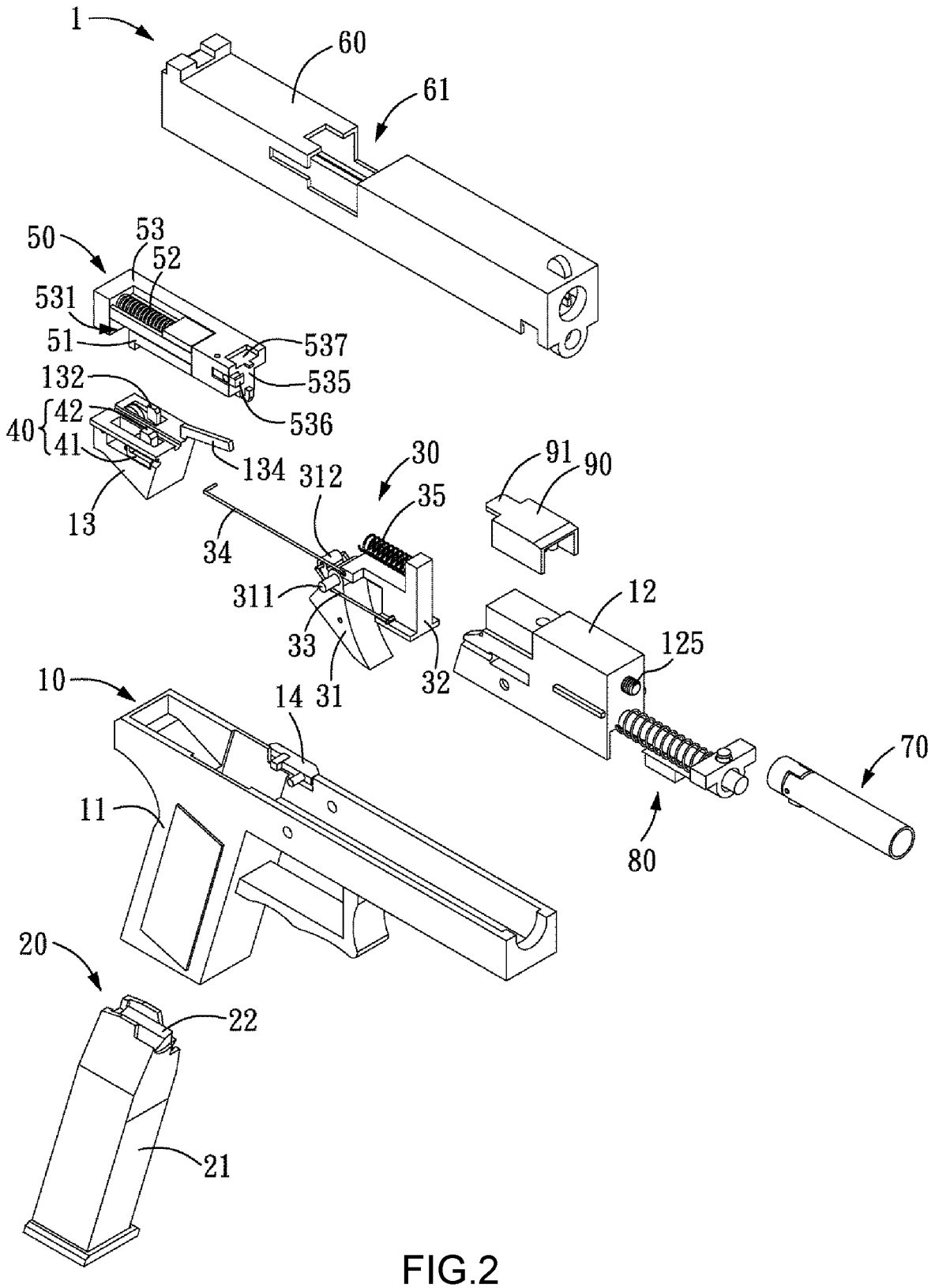
FIG. 2 is an exploded schematic diagram of the toy gun in FIG. 1.
Figure 3:
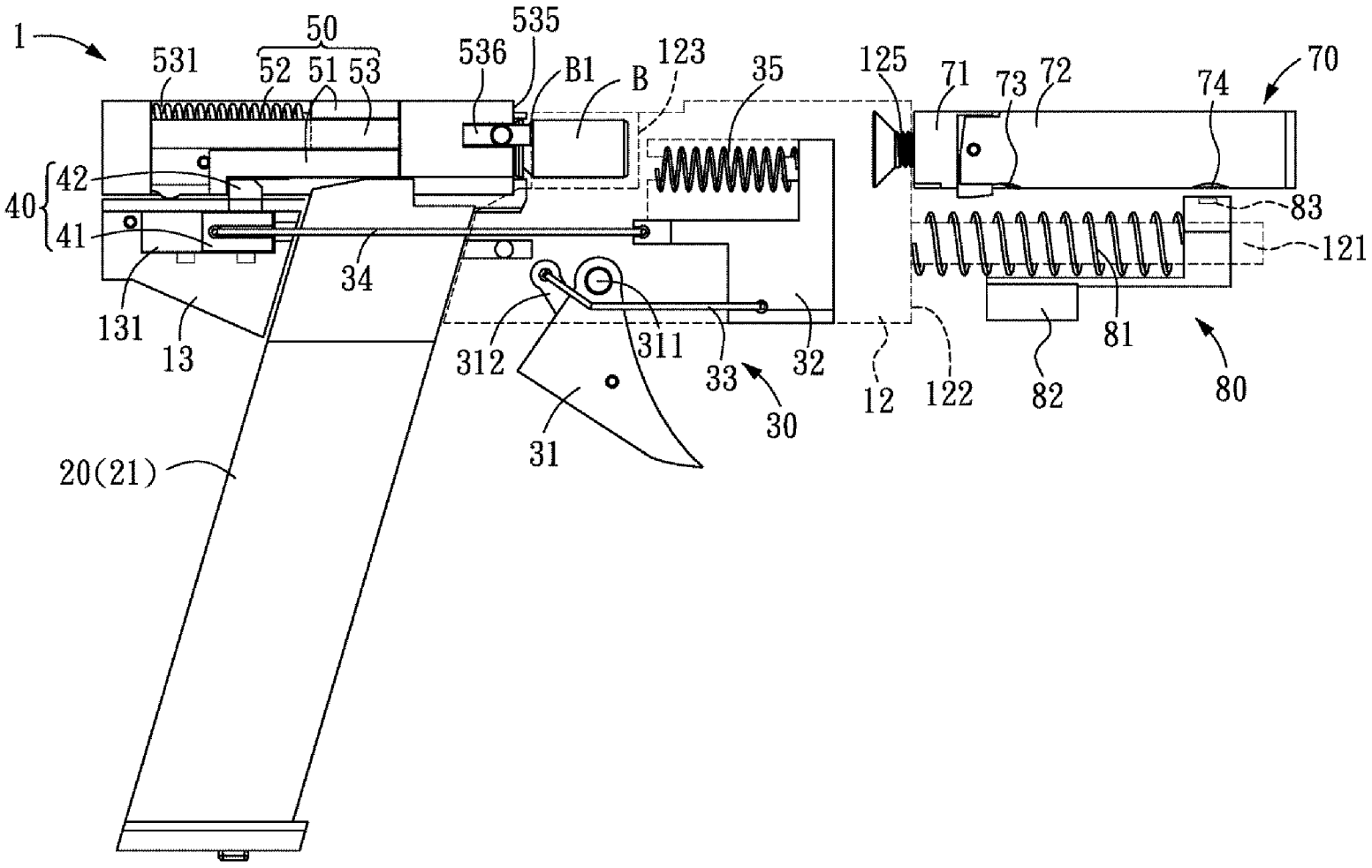
FIG. 3 is a schematic diagram of the toy gun in FIG. 1, with a reciprocating slide and a receiver housing removed.
Figure 4A:
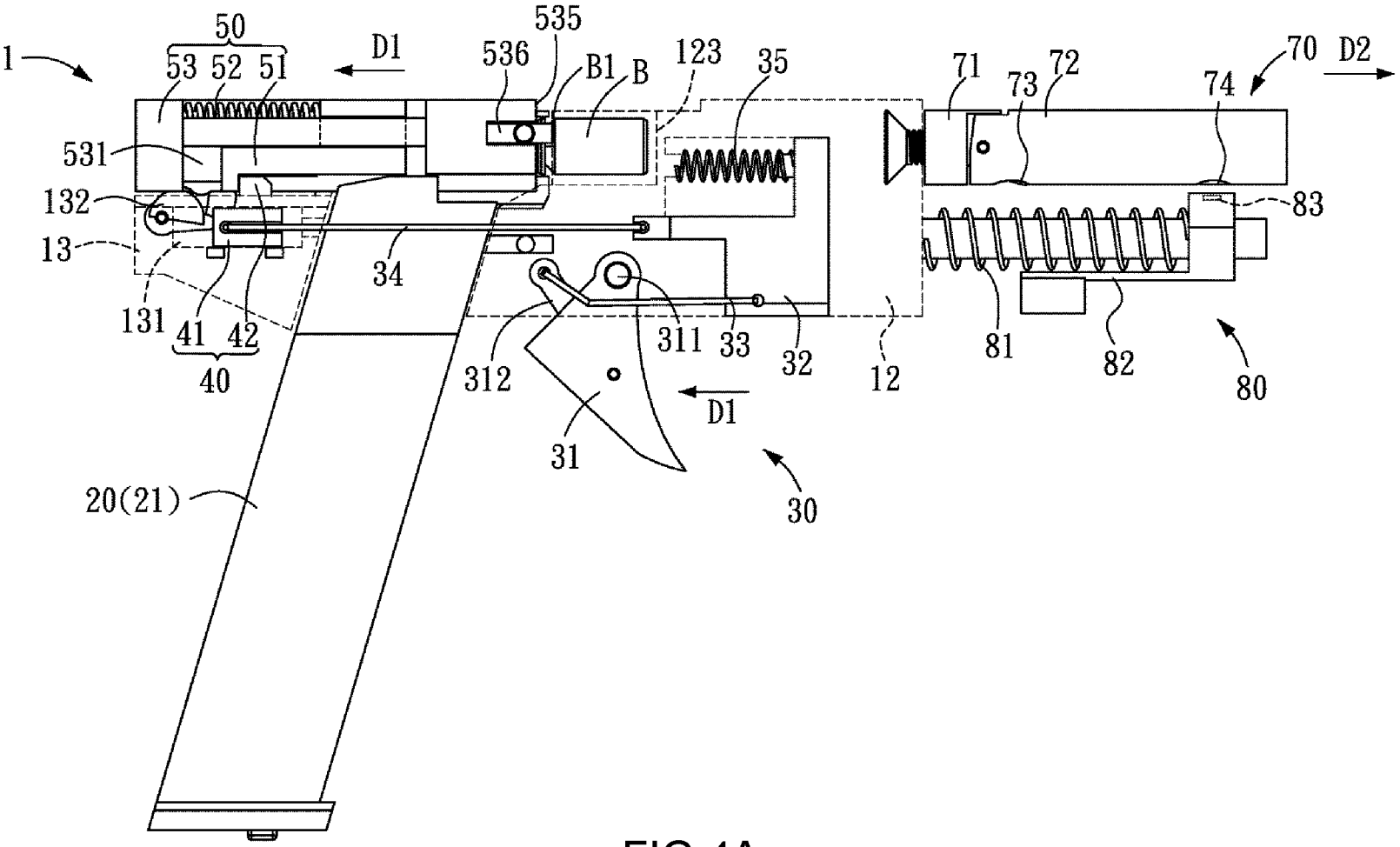
FIG. 4A is a schematic diagram of an initial operation of the toy gun in FIG. 3.
Figure 4B:
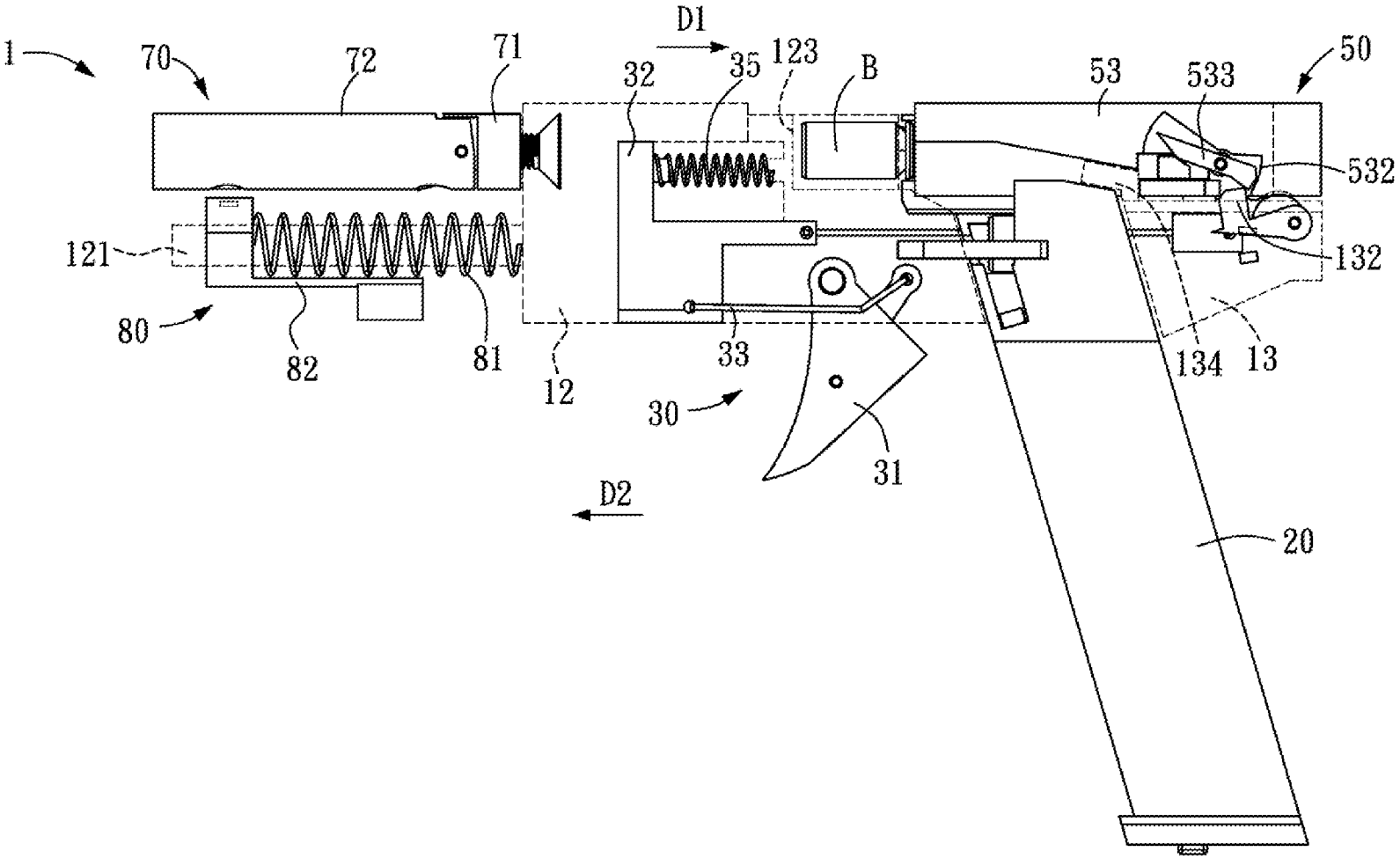
FIG. 4B is a rear diagram of the toy gun in FIG. 4A.
Figure 5:
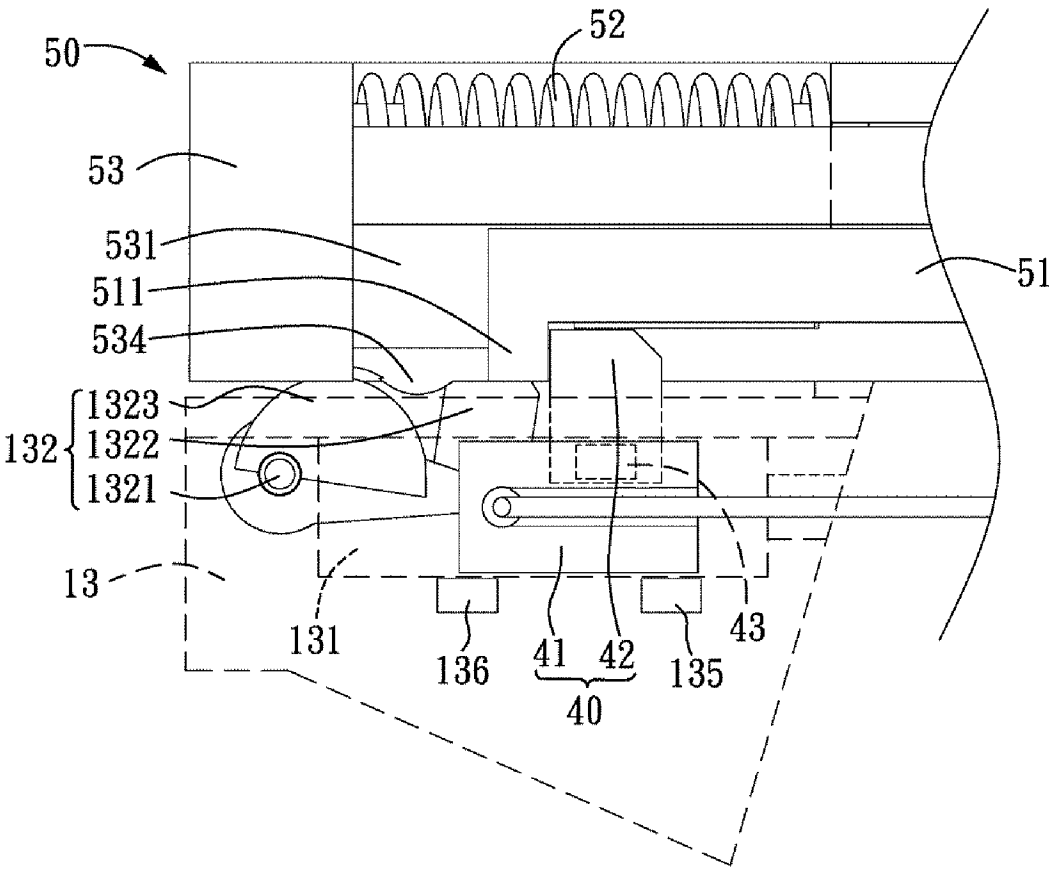
FIG. 5 is an enlarged schematic diagram of a sear assembly and a blowback assembly in FIG. 4A.

FIG. 1 shows a schematic diagram of a toy gun according to an embodiment of the present invention. FIG. 2 shows an exploded schematic diagram of the toy gun in FIG. 1. FIG. 3 shows a schematic diagram of the toy gun in FIG. 1, with a reciprocating slide and a receiver housing removed. FIG. 4A shows a schematic diagram of an initial operation of the toy gun in FIG. 3. FIG. 4B shows a rear diagram of the toy gun in FIG. 4A. FIG. 5 shows an enlarged schematic diagram of a sear assembly and a blowback assembly in FIG. 4A. The description below is given with reference to the above drawings. A toy gun 1 of this embodiment can be used to fire a cartridge case B. It should be noted that, in this embodiment, a bullet includes only a cartridge case but does not include a warhead or a projectile. In other words, the toy gun 1 of this embodiment does not fire a warhead of a bullet, but simulates a scenario wherein the cartridge case B is ejected as a bullet is fired by a real gun. Thus, the term "bullet" used in the description below is to be equivalently regarded as the term "cartridge case". In other embodiments, the toy gun 1 may also include a penetrated barrel structure, so that a bullet including a warhead or a projectile can be applied. Although the toy gun is used for explanation in the embodiment of the present invention, it should be noted that, the present invention also could apply to different types of guns or devices, such as real gun, training gun, training device, dry fire training device, or reloading drill device.

In this embodiment, the toy gun 1 includes receiver assembly 10, a magazine 20, a trigger assembly 30, a sear assembly 40, a blowback assembly 50, a reciprocating slide 60 and a barrel assembly 70. The magazine 20 is detachably installed on the receiver assembly 10, and the trigger assembly 30 and the sear assembly 40 are both accommodated in the receiver assembly 10. Moreover, the trigger assembly 30 is located on a front side of the magazine 20 and the sear assembly 40 is located on a rear side of the magazine 20. It should be noted that, one side toward or close to the barrel assembly 70 of this embodiment is primarily referred to as a front side, and vice versa, referred to as a rear side. Thus, the trigger assembly 30 is located on one side of the magazine 20 close to the barrel assembly 70, and the sear assembly 40 is located on one side of the magazine 20 away from the barrel assembly 70.

Preferably, the receiver assembly 10 of this embodiment includes a receiver housing 11, a first body 12 and a second body 13. The receiver housing 11 contributes to the appearance of a receiver of the toy gun 1, and the receiver housing 11 and the reciprocal slide 60 form the overall appearance of the toy gun 1. For better clarity, the receiver housing 11 and the reciprocal slide 60 are omitted from FIG. 3. The first body 12 and the second body 13 are accommodated in the receiver housing 11, the first body 12 is located on the front side of the magazine 20, and the second body 13 is located on the rear side of the magazine 20. Thus, the trigger assembly 30 is arranged on the first body 12, and the sear assembly 40 is arranged on the second body 13.

The trigger assembly 30 of this embodiment includes a trigger 31, a trigger slide 32, a first connecting member 33 and a second connecting member 34. The trigger 31 pivots to the first body 12 of the receiver assembly 10. Preferably, the trigger 31 has a connecting shaft 311. The connecting shaft 311 passes through the receiver housing 11, the first body 12 and the trigger 31, allowing the trigger 31 to pivot to the receiver assembly 10. Moreover, the trigger slide 32 is movably arranged in the first body 12. More specifically, the inside of the first body 12 can be a structure that is partially hollow or has a slot, so that the trigger slide 32 can be accommodated in the first body 12 and move back and forth in the first body 12.

Two opposite ends of the first connecting member 33 connect to the trigger 31 and the trigger slide 32, respectively. One end of the second connecting member 34 connects to the trigger slide 32, and the other connects to the sear assembly 40 located on the rear side. In this embodiment, the first connecting member 33 and the second connecting member 34 can be metal wires, for example, iron wires or copper wires.

In this embodiment, the sear assembly 40 includes a sear base 41 and a sear 42. The sear base 41 is movably arranged in the second body 13, and the sear base 41 connects to the other end of the second connecting member 34. In other words, the two opposite ends of the second connecting member 34 connect to the trigger slide 32 and the sear base 41, respectively. More specifically, the second body 13 has a slide channel 131 (as shown in FIG. 5), and the sear base 41 is arranged at the slide channel 131. Preferably, the slide channel 131 has an open end to expose the sear base 41. The second connecting member 34 can connect to the sear base 41 from the open end of the slide channel 131. Moreover, the sear 42 is arranged on the sear base 41, and the sear 42 protrudes from the sear base 41 to further coordinate with the structure of the blowback assembly 50 located on an upper side of the second body 13.

Figure 6:
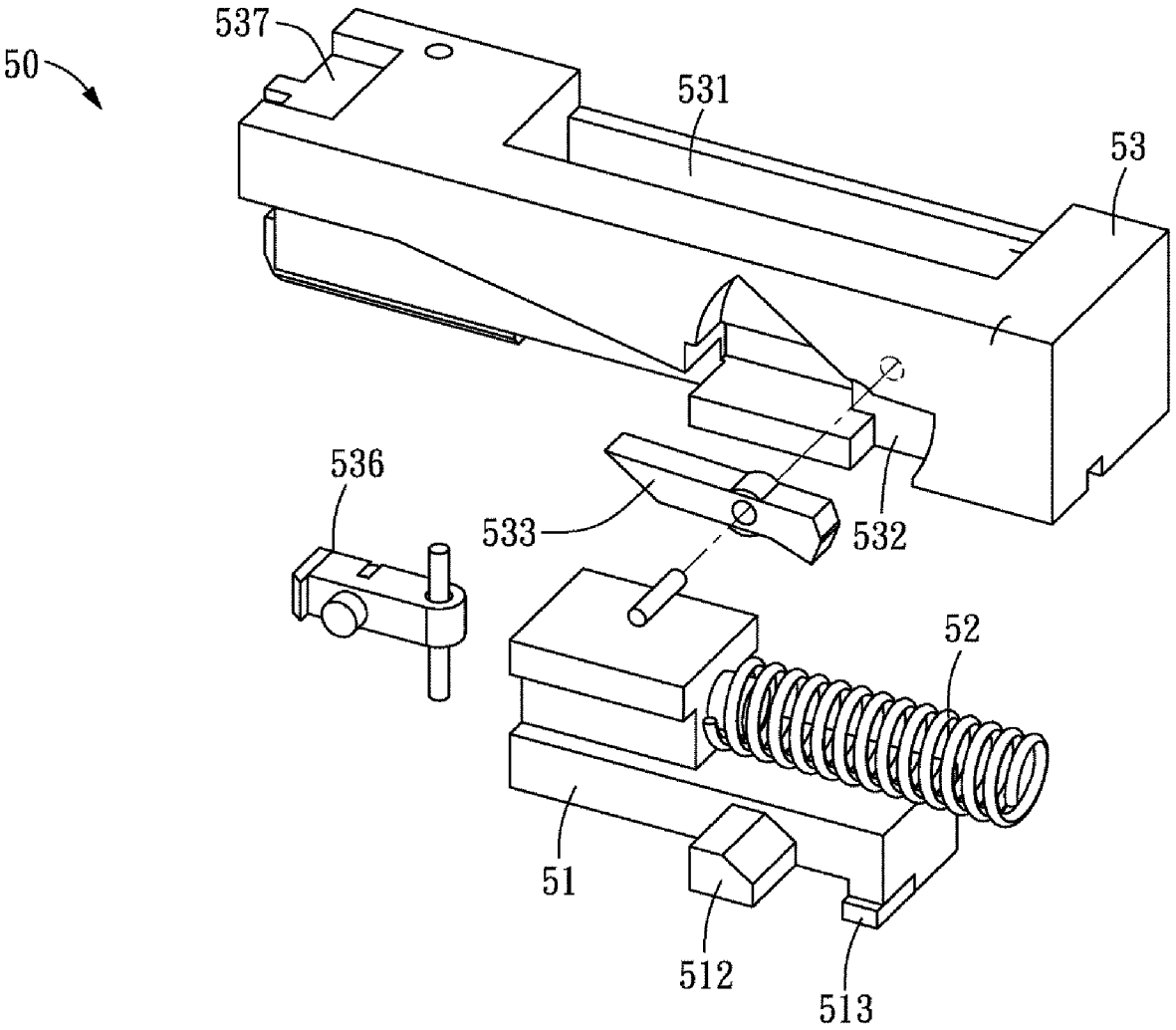
FIG. 6 is an exploded schematic diagram of a blowback assembly in FIG. 2.

FIG. 6 shows an exploded schematic diagram of the blowback assembly in FIG. 2. Refer to FIG. 5 and FIG. 6. More specifically, the blowback assembly 50 includes a energy-storing slide 51, a blowback spring 52 and a blowback slide 53. The energy-storing slide 51 is engaged with the sear 42 of the sear assembly 40. The energy-storing slide 51 of this embodiment protrudes from one side (that is, a lower side) facing the sear assembly 40 to form a stop portion 511 (refer to FIG. 15A for a three-dimensional structure thereof), so as to be engaged with the sear 42. In other embodiments, a groove, or other structure that can be engaged with the sear 42, can also be formed on a lower side of the energy-storing slide 51; that is, such is not specifically defined by the present invention.

Moreover, the energy-storing slide 51 and the blowback spring 52 are arranged in the blowback slide 53, and one end of the blowback slide 52 close to the magazine 20 abuts against the energy-storing slide 51. More specifically, the inside of the blowback slide 53 has a slide channel 531, and the energy-storing slide 51 and the blowback spring 52 are both accommodated in the slide channel 531. The energy-storing slide 51 is located on a front side (one side close to the magazine 20), and the blowback spring 52 is located on a rear side. Thus, two opposite ends of the blowback spring 52 abut against inner walls of the energy-storing block 51 and the slide channel 531, respectively.

As shown in FIG. 1 and FIG. 2, the reciprocal slide 60 of this embodiment sleeves on the receiver assembly 10, and this means sleeving on an outer side of the first body 12 herein. In addition, the reciprocal slide 60 further connects to the blowback slide 53. Thus, the reciprocal slide 60 and the blowback slide 53 mutually drive each other to move, that is, the reciprocal slide 60 and the blowback slide 53 operate together.

Referring to both FIG. 3 and FIG. 4A, when the trigger 31 rotates toward a first direction D1, the first connecting member 33 pulls the trigger slide 32 to move linearly towards the first direction D1, and the second connecting member 34, the sear assembly 40 and the energy-storing slide 51 sequentially move linearly towards the first direction D1. More specifically, when a user (player) pulls the trigger 31, the trigger 31 rotates with respect to the connecting shaft 31 as an axis, such that an end of the trigger 31 rotates towards the first direction D1, that is, rotating backward. In other words, the trigger 31, when receiving an external force (that is, a force by which the user presses the trigger 31) in a first direction D1, is capable of pivotally rotating backward relative to the receiver assembly 10. The force by which the trigger 31 rotates backward is capable of pulling the first connecting member 33 and the trigger slide 32 to move linearly backward.

Preferably, the trigger 31 further includes a link rod 312, and is, as shown in FIG. 2 and FIG. 3, located on one side close to the magazine 20; that is, the link rod 312 is located on a rear side of the trigger 31. Two opposite ends of the first connecting member 33 connect to the link rod 312 and the trigger slide 32, respectively. With the link rod 312 provided, the first connecting member 33 is allowed to move linearly in a stable manner, and to remain unaffected from influences of rotating of the trigger 31. In addition, the trigger slide 32 is arranged in the first body 12, so that the first body 12 can limit the trigger slide 32, and this similarly achieves an effect of allowing the first connecting member 33 to move linearly in a stable manner.

Next, the trigger slide 32 can push the second connecting member 34 to move linearly towards the first direction D1 (that is, moving backward). Because the other end of the second connecting member 34 connects to the sear base 41, the sear assembly 40 is pushed by the second connecting member 34 and thus moves backward. In addition, the second connecting member 34 first passes by an outer surface of the magazine 20, and then connects to the sear base 41. Preferably, a magazine housing 21 of the magazine 20 can have a linear guide groove to accommodate the second connecting member 34. With limiting provided by the guide groove, the second connecting member 34 is also allowed to achieve an effect of moving linearly in a stable manner.

Moreover, because the sear 42 arranged at the sear base 41 is engaged with the energy-storing slide 51, the sear 42 is capable of driving the energy-storing slide 51 to move backward. It should be noted that, the first body 12 and the second body 13 are immobile members, and the trigger slide 32 and the sear assembly 40 move back and forth inside the first body 12 and the second body 13, respectively. The force-slide 51 moves backward and compresses the blowback spring 52, as shown in FIG. 4A, FIG. 4B and FIG. 5.

Figure 7A:
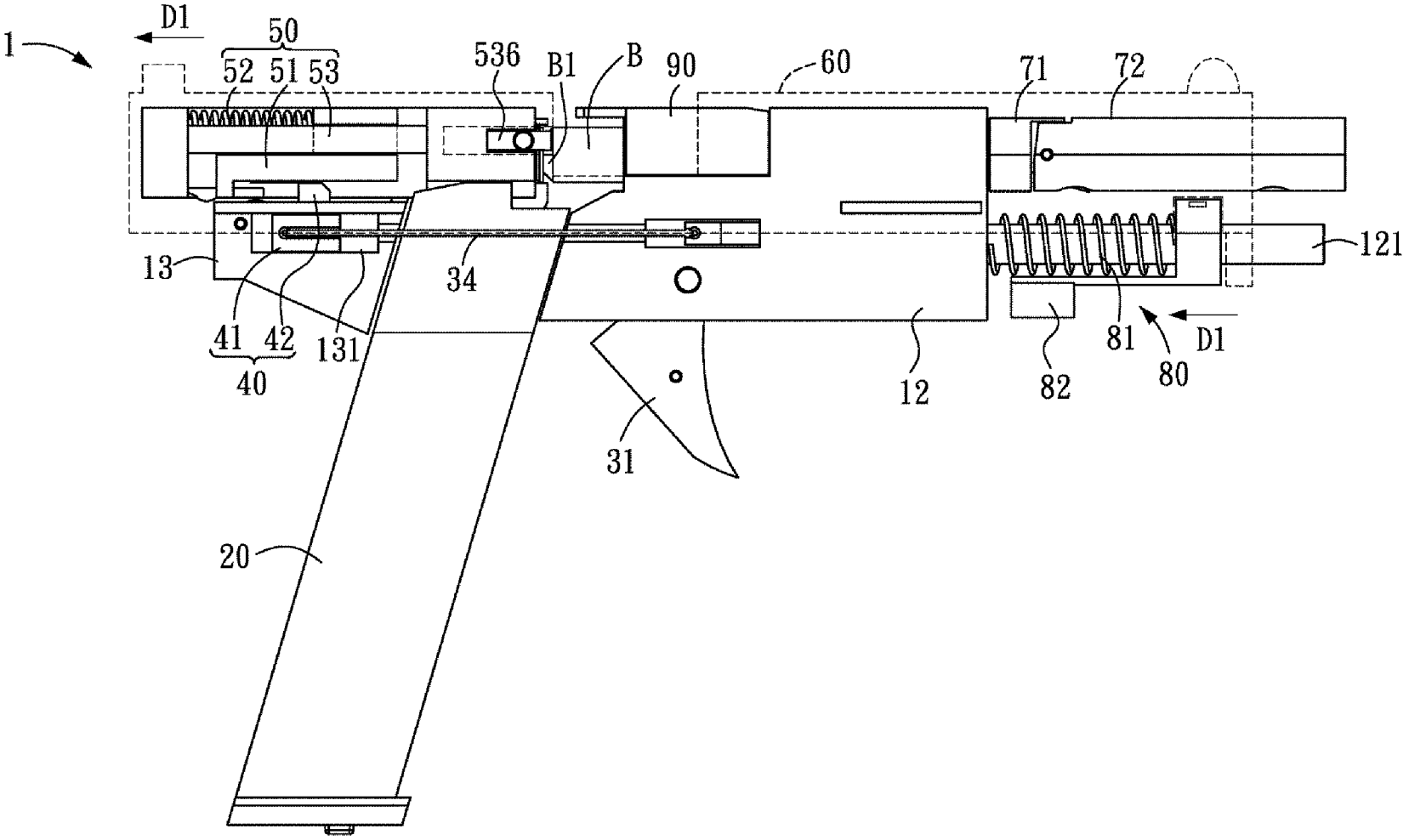
FIG. 7A is a schematic diagram of a blowback slide in FIG. 4A moving towards a first direction.
Figure 7B:
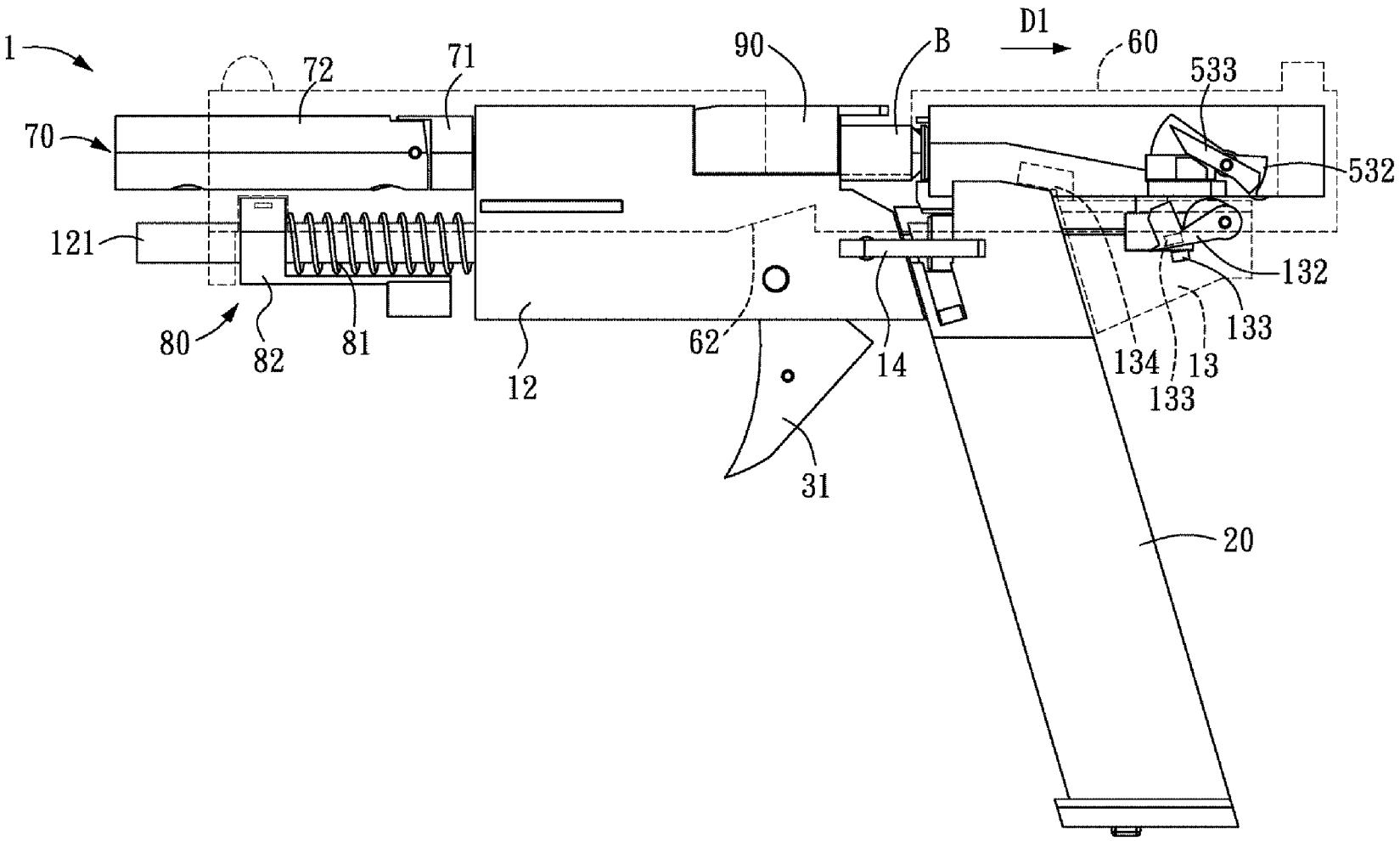
FIG. 7B is a rear diagram of the toy gun in FIG. 7A.
Figure 8:
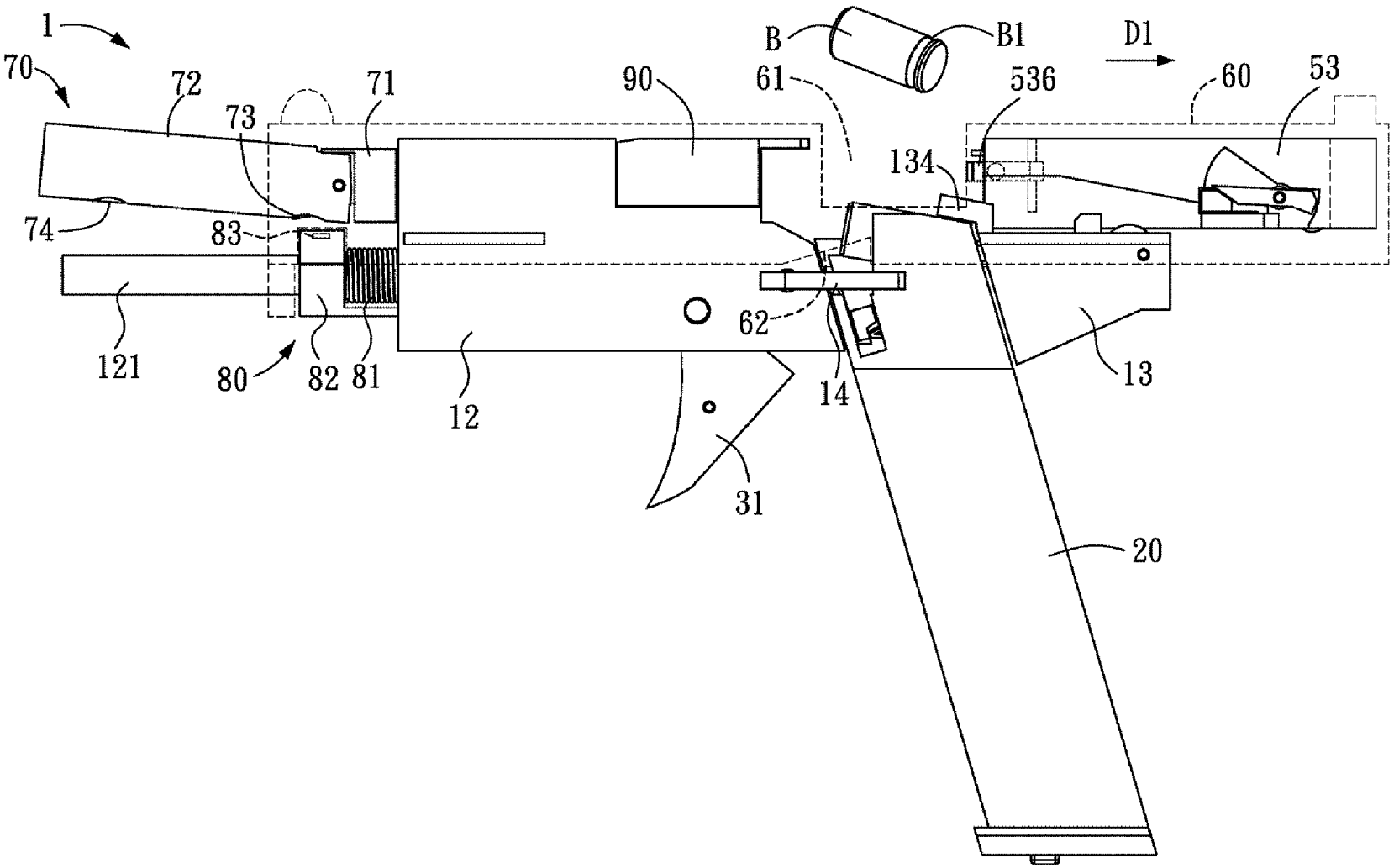
FIG. 8 is a schematic diagram of the blowback assembly in FIG. 7A having moved to the end.

FIG. 7A shows a schematic diagram of the blowback slide in FIG. 4A moving toward the first direction. FIG. 7B shows a rear diagram of the toy gun in FIG. 7A. FIG. 8 shows a schematic diagram of the blowback slide in FIG. 7A having moved to the end. Refer to FIG. 7A, FIG. 7B and FIG. 8. When the compressed blowback spring 52 restores to an original state, the blowback slide 53 receives the restoring energy of the blowback spring 52 and continues moving towards the first direction D1. Meanwhile, the blowback slide 53 also drives the reciprocal slide 60 to jointly move towards the first direction D1, so as to complete a blowback action of the reciprocal slide 60. Thus, the toy gun 1 of this embodiment achieves a simulation effect of rotating actions of the trigger 31, as well as a simulation effect of the blowback actions of the reciprocating slide 60. In addition, with the multiple elements of the trigger assembly 30 connecting to one another and the structure connecting to the sear assembly 40, an action stroke of the trigger 31 can be magnified. More specifically, the first connecting member 33 connects to the trigger 31 and the trigger slide 32, and the second connecting member 34 connects to the sear slide 32 and the sear assembly 40, so that a press stroke of the trigger 31 can be magnified by the first connecting member 33 and the second connecting member 34. Thus, by merely pulling the trigger 31 for a small distance (as shown in FIG. 4A and FIG. 4B), the subsequent sear assembly 40 can be driven to start operating, further enabling blowback of the reciprocal slide 60.

Figure 9A:
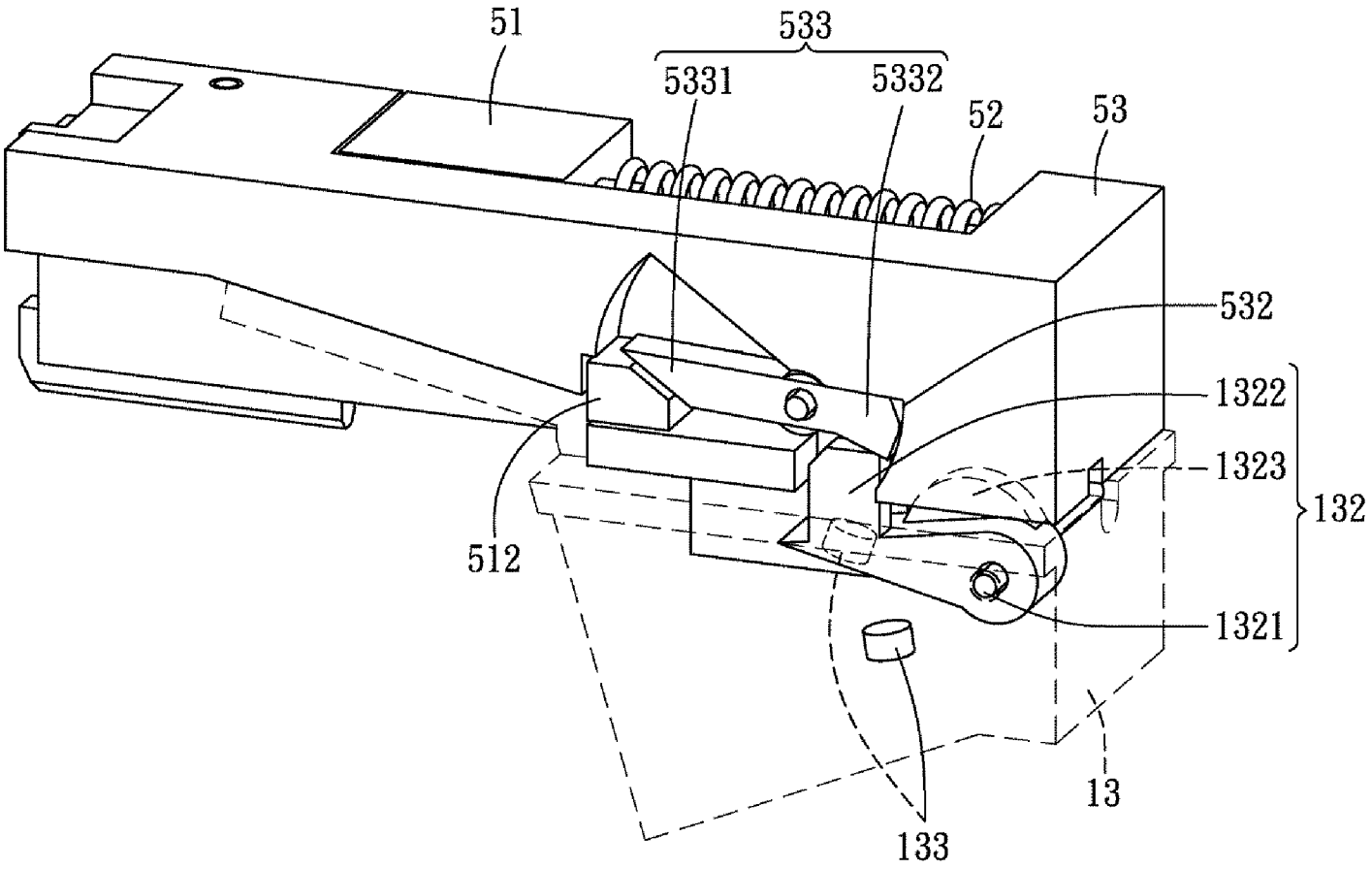
FIG. 9A to FIG. 9C are schematic diagrams of an unlocking operation of a locking member in FIG. 4B.
Figure 9B:
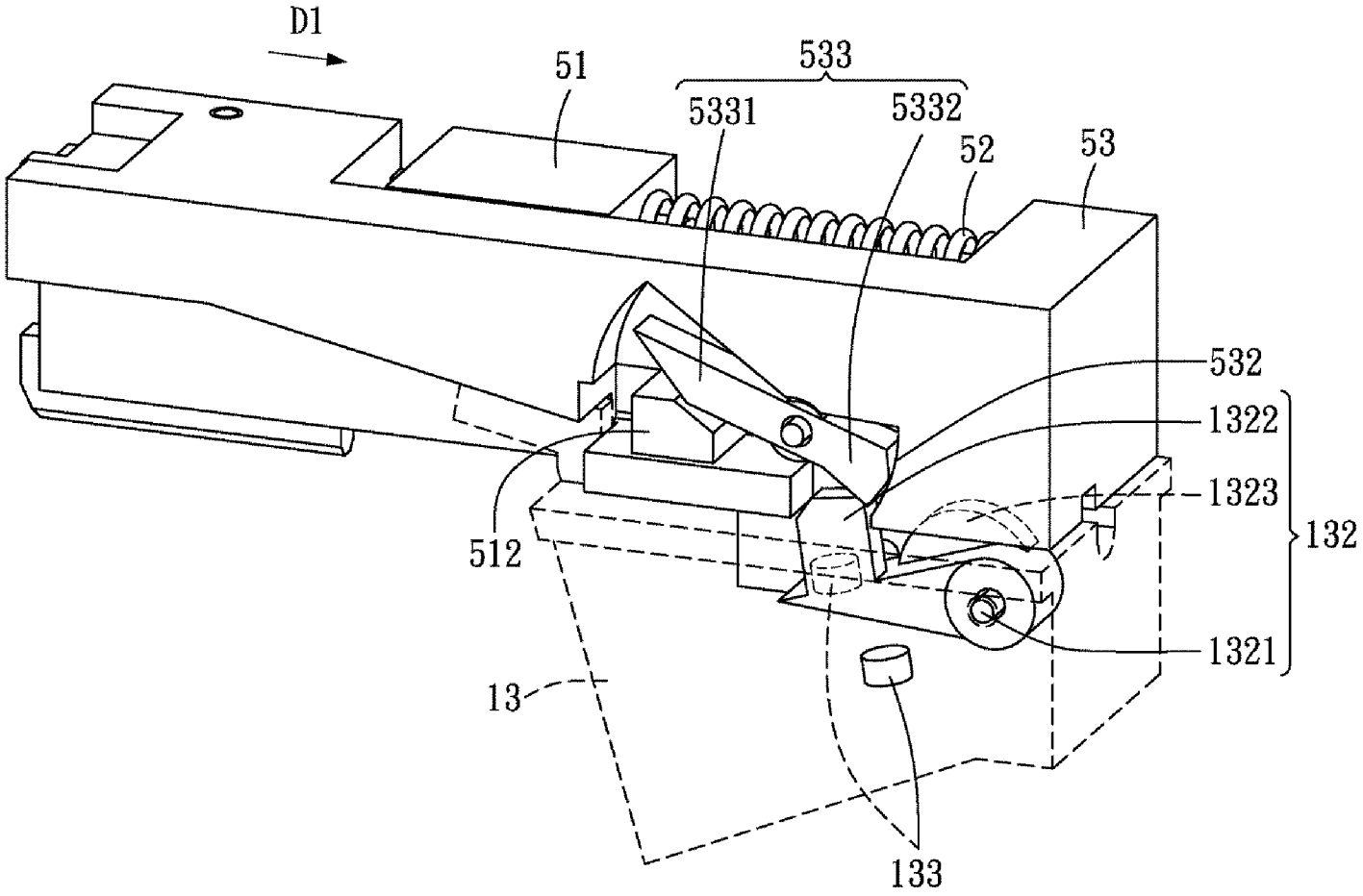
Figure 9C:
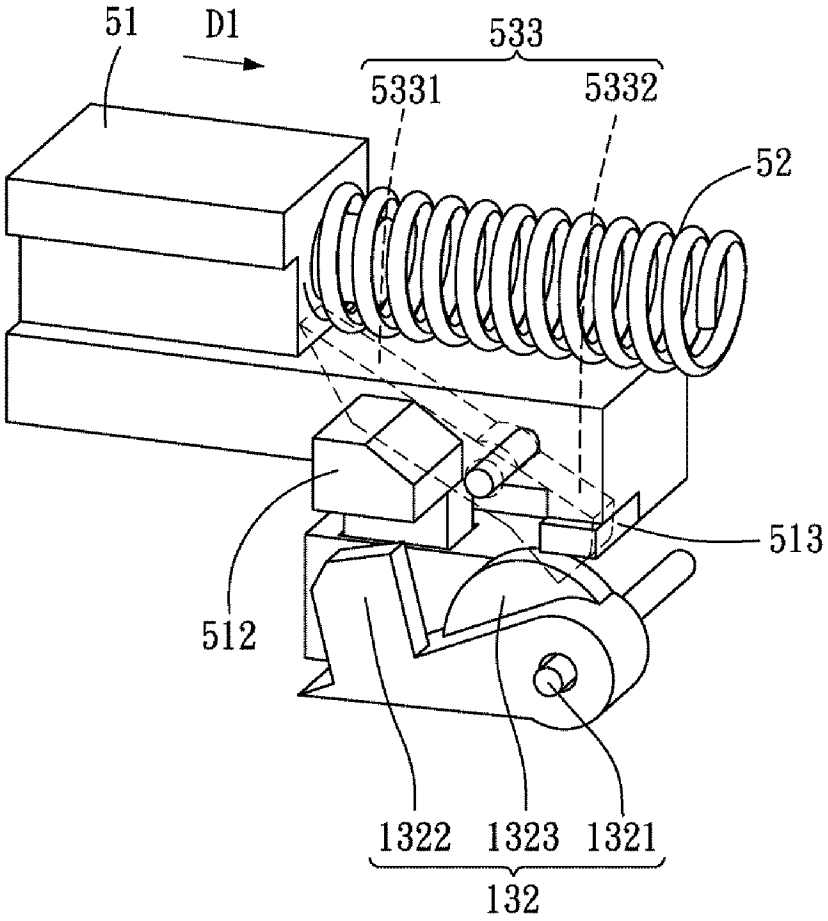

As shown in FIG. 4B and FIG. 7B, preferably, the reciprocal slide 53 includes a locking slot 532, which is located on a surface of the reciprocal slide 53 facing the second body 13. Correspondingly, the second body 13 includes a locking member 132 arranged inside the second body 13. FIG. 9A to FIG. 9C show schematic diagrams of an unlocking operation of the locking member in FIG. 4B. FIG. 9A corresponds to a non-operating state and an unlock state of the trigger assembly 30 in FIG. 3. FIG. 9B corresponds to a state of an initial operation in FIG. 4A and FIG. 4B. FIG. 9C corresponds to an operating state in FIG. 7A and FIG. 7B. For better simplicity and clarity of the drawings, the reciprocal slide and the second body are omitted from FIG. 9C. In a locked state, as shown in FIG. 4B or FIG. 9A, the locking member 132 protrudes from the second body 13, and is engaged in the locking slot 532. In an unlocked state, as shown in FIG. 7B or FIG. 9C, the locking member 132 is accommodated in the second body 13 so as to release the blowback slide 53.

More specifically, when the energy-storing slide 51 moves backward (that is, toward the first direction D1) and compresses the blowback spring 52, as shown in FIG. 4B, the locking member 132 and the locking slot 532 are still in a locked state, such that the energy-storing slide 51 is given enough time to compress the blowback spring. The state above then transitions to an unlocked state, in which the blowback spring 52 provides a sufficient elastic force (restoring energy) to push the blowback slide 53 backward, as shown in FIG. 7B to FIG. 8, so as to achieve a simulation effect of a blowback action.

In this embodiment, an unlocking structure between the locking member 132 and the locking slot 532 is located in the energy-storing slide 51. Thus, during the process of the sear 42 pulling the energy-storing slide 51 to move towards the first direction D1 as a result of a user pulling the trigger 31, the locking member 132 and the locking slot 532 are also unlocked. More specifically, the energy-storing slide 51 includes at least one unlock protrusion, and as shown in FIG. 6, two unlock protrusions, respectively referred to as a first unlocking protrusion 512 and a second unlocking protrusion 513, are used as an example in the description of this embodiment. The first unlocking protrusion 512 is located on the front end (close to the magazine 20, the left side in terms of the viewing angle of FIG. 6), and the second unlocking protrusion 513 is located on the rear end (the left side in terms of the viewing angle in FIG. 6). The first unlocking protrusion 512 and the second unlocking protrusion 513 are both formed by extending from one sidewall of the energy-storing slide 51 close to the locking member 132, as shown in FIG. 9C. In other words, the first unlocking protrusion 512 and the second unlocking protrusion 513 protrude from the sidewall of the energy-storing slide 51 in a direction toward the locking member 132.

When the energy-storing slide 51 moves towards the first direction D1, the first unlocking protrusion 512 can indirectly press the locking member 132, as shown in FIG. 9B, allowing the locking member 132 to depart from the locking slot 532 (an unlocked state) of the blowback slide 53 to achieve a function of unlocking. The second unlocking protrusion 513 of this embodiment can directly press the locking member 132, as shown in FIG. 9C, similarly achieving a function of unlocking.

Referring to FIG. 9A and FIG. 9B, an operation of the first unlocking protrusion 512 indirectly pressing the locking member 132 is described below. In this embodiment, the blowback slide 53 includes an unlocking lever 533, which is located in the locking slot 532. The unlocking lever 533 has a first end 5331 and a second end 5332 opposite to each other. In a locked state, the first end 5331 is adjacent to the first unlocking protrusion 512, for example, located on an upper edge of the first unlocking protrusion 512. The second end 5332 is adjacent to the locking member 132, for example, located on an upper edge of the locking member 132. Thus, when the energy-storing slide 51 moves towards the first direction D1 (backward), the first unlocking protrusion 512 can be lifted to unlock the first end 5331 of the unlocking lever 533, and the second end 5332 presses the locking member 132 downward, as shown in FIG. 9B. After the locking member 132 is pressed downward by the second end 5332 and departs from the locking slot 532 (unlocked state), the unlocking operation of the blowback slide 53 is achieved.

Preferably, the first end 5331 of the unlocking lever 533 is an inclined surface, and the first unlocking protrusion 512 correspondingly has a bevel angle. The inclined surface of the first end 5331 coordinates with the bevel angle of the first unlocking protrusion 512, and both the inclined surface and the bevel angle extend downward and backward (obliquely). With the structures of the inclined surface and the bevel angle, the first unlocking protrusion 512 is allowed to accurately lift the first end 5331 of the unlocking lever 533, so as to complete the unlocking operation.

Preferably, the locking member 132 pivots to the second body 13, for example, connecting to the first body 12 by a pivotal shaft 1321. Moreover, the pivotal shaft 1321 can be located on a rear end of the locking member 132. As such, given that the locking member 132 is pressed by any unlocking protrusion (the first unlocking protrusion 512 or the second unlocking protrusion 513), the locking member 132 is capable of rotating with respect to the pivotal shaft 1321 as an axis toward the inside of the second body 13, further departing from the locking slot 532 (unlocked state) of the blowback slide 53.

In this embodiment, the locking member 132 includes a first press-down portion 1322 and a second press-down portion 1323. The second end 5332 of the unlocking lever 533 is located on an upper edge of the first press-down portion 1322, so that the second end 5332 can press the first press-down portion 1322 after the first unlocking portion 512 lifts the first end 5331 of the unlocking lever 533. Moreover, the second unlocking protrusion 513 corresponds to the second press-down portion 1323 and can directly press the second press-down portion 1323.

Preferably, the second press-down portion 1323 is closer to the pivotal shaft 1321 of the locking member 132 than the first press-down portion 1322. That is, the first press-down portion 1322 is located on a front end (the left side in terms of the viewing angle of FIG. 9A), and the second press-down portion 1323 is located on a rear end (the left side in terms of the viewing angle of FIG. 9A). Correspondingly, the energy-storing slide 51 is sequentially the first unlocking protrusion 512 and the second unlocking protrusion 513 from front to back (referring to FIG. 9C), the second unlocking portion 512 extends by a longer length from the sidewall, and the second unlocking protrusion 513 extends by a shorter length and has a narrower width. Thus, when the energy-storing slide 51 moves towards the first direction D1, the first unlocking protrusion 512 can first lift the unlocking lever 533, such that the second end 5332 of the unlocking lever 533 presses the first press-down portion 1322. At this point, the shorter and narrower second unlocking portion 513 can then avoid the unlocking lever 533 and the first press-down portion 1322, and continue to move backward to the second press-down portion 1323.

As described above, when the locking member 132 is pressed down to the inside of the second body 13, the blowback slide 53 receives the restoring energy of the blowback spring 52 and continues moving towards the first direction D1. Meanwhile, the bottom (a region that is not the locking slot 532) of the blowback slide 53 can continuously press the locking member 132 to maintain an unlocked state. Preferably, the second body 13 further includes a reset structure 133, which is accommodated in the second body 13 and corresponds to a bottom side of the locking member 132. The reset structure 133 can be, for example but not limited to, a spring or a pair of magnets of the same polarity.

In this embodiment, a pair of magnets of the same polarity (for example, both being the S-polarity or both being the N-polarity) are taken as an example. It should be noted that, the so-called the same polarity in this embodiment refers to the corresponding sides of the two magnets have the same polarity. One of the magnets of the reset structure 133 is arranged on the bottom side of the locking member 132, and the other magnet is arranged in the second body 13, as shown in FIG. 9A and FIG. 9C.

When the blowback slide 53 and the reciprocal slide 60 are reset to original positions, the locking slot 532 corresponds to the locking member 132. At this point, due to a repulsive force of the same polarity of the two magnets of the reset structure 133, the locking member 132 is driven by the repulsive force and is reset in the locking slot 532 so as to return to a locked state. In an embodiment where the reset structure 133 is a spring, the locking member 132 is drive by a restoring energy of the spring and reset in the locking slot 532.

As shown in FIG. 2 and FIG. 3, the toy gun 1 further includes a reset assembly 80, which is used to reset the blowback slide 53 and the reciprocal slide 60 back to original positions. More specifically, the first body 12 includes an elongated portion 121, for example, a long pipe. The elongated portion 121 is located on a front sidewall 122 of the first body 12, that is, the elongated portion 121 is located on one side of the first body 12 opposite to the magazine 20. Moreover, the reset assembly 80 includes a reset spring 81 and a reset slide 82. The reset spring 81 sleeves on the elongated portion 121, and the reset slide 82 is arranged on one side of the reset spring 81 opposite to the front sidewall 122. In other words, two opposite ends of the reset spring 81 are in contact with the front sidewall 122 of the first body 12 and the reset slide 82, respectively. Moreover, the reset slide 82 connects to the reciprocal slide 60, such that the reciprocal slide 60 and the reset slide 82 can drive and move each other; that is, the reciprocal slide 60, the reset slide 82 and the foregoing blowback slide 53 can move back and forth in unity.

When the reset slide 82 moves along with the reciprocal slide 60 towards the first direction D1, the reset spring 81 is compressed by the reset slide 82, as shown in FIG. 8. Then, a restoring energy of the reset spring 81 drives the reset slide 82 and the reciprocal slide 60 to move toward a second direction D2 (referring to FIG. 12), wherein the second direction D2 is opposite to the first direction D1. That is, the second direction D2 is a forward direction for moving toward a direction of the barrel assembly 70. Meanwhile, the blowback slide 53 is also driven by the reciprocal slide 60 to move towards the second direction D2, and is reset to an original position before the trigger 31 is pulled, that is, reset to the position in FIG. 7A (or FIG. 7B) and FIG. 4A (or FIG. 4B). Next, the energy-storing slide 51 located in the blowback slide 53 and the blowback spring 52 are also reset to original positions, as shown in FIG. 3.

Regarding the reset operations of the sear assembly 40 and the trigger assembly 30, as shown in FIG. 2 and FIG. 3, the trigger assembly 30 of this embodiment further includes a trigger spring 35, and the reset operation of the trigger assembly 30 is assisted by the trigger spring 35. The trigger spring 35 is arranged in the first body 12, and has one end abutting against the trigger slide 32. More specifically, a front end of the trigger spring 35 connects to the trigger slide 32, and a rear end is in contact with an inner wall of the first body 12. Since the first body 12 is an immobile element, when the user pulls the trigger 31, the first connecting plate 33 pulls the trigger slide 32 to move linearly towards the first direction D1, and the trigger spring 35 is compressed by the trigger slide 32, as shown in FIG. 4A and FIG. 4B. When the user stops pulling the trigger 31, that is, when the trigger 31 stops receiving the force, the trigger slide 32 is pushed by a restoring energy of the trigger spring 35 to move towards the second direction D2, so as to reset to an original position (as shown in FIG. 3). Meanwhile, the trigger slide 32 pulls the first connecting plate 33 and the second connecting plate 34 to reset to original positions, and the first connecting plate 33 and the second connecting plate 34 respectively pull the trigger 31 and the sear base 41 to reset to original positions, thereby completing reset of the trigger assembly 30 and the sear assembly 40. In other embodiments, the sear assembly 40 and the trigger assembly 30 can also be pulled to be sequentially reset while the energy-storing slide 51 is reset.

Preferably, the sear 42 of this embodiment can enter the sear base 41, so as to prevent the sear 42 from affecting the reset strokes of the blowback assembly 50 and the reciprocal slide 60. More specifically, as shown in FIG. 3 and FIG. 4A, when the sear base 41 is located on a front end of the slide channel 131, the sear 42 protrudes from the sear base 41 so as to be engaged with the stop portion 511 of the energy-storing slide 51, further driving the energy-storing slide 51 to move towards the first direction D1. When the sear base 41 moves towards the first direction D1 to a rear end of the slide channel 131, the sear 42 can be accommodated in the sear base 41. At this point, even if the reciprocal slide 60 drives the blowback assembly 50 to reset towards the second direction D2, it is not obstructed by the sear 42 protruding from the sear base 41.

In this embodiment, with the magnets of different polarities provided on the second body 13, the operation of accommodating the sear 42 in the sear base 41 can be accomplished when the sear base 41 moves to the rear end of the slide channel 131. As shown in FIG. 5, the sear assembly 40 of this embodiment further includes a magnet 43, which is arranged on a lower surface of the sear 42. Moreover, the second body 13 further includes two magnets 135 and 136, which are arranged on the front end and the rear end of the slide channel 131, respectively. The magnet 135 located on the front end of the slide channel 131 and the magnet 43 of the sear assembly 40 have the same polarity (for example, both being the N-polarity or both of the S-polarity). The magnet 136 located on the rear end of the slide channel 131 and the magnet 43 have opposite polarities (for example, one being the N-polarity and the other being the S-polarity). When the sear base 41 is located on the front end of the slide channel 131, the sear 42 protrudes from the sear base 41 as a result of the repulsion of the same polarity of the magnet 135 and the magnet 43, as shown in FIG. 3. Conversely, when the sear base 41 moves to the rear end of the slide channel 131, the sear 42 is pulled to the inside of the sear base 41 due to attraction of opposite polarities of the magnet 136 and the magnet 43.

In this embodiment, when the trigger 31 of the toy gun 1 is pulled, the reciprocal slide 60 moves towards the first direction D1 (backward), and a case ejecting action (ejecting the cartridge case B) is produced. Conversely, while the reciprocal slide 60 is reset, a loading action of the cartridge case B (or loading a bullet) is produced. Mechanisms of case ejection and bullet loading of the toy gun 1 of this embodiment are further described below.

Figure 10:
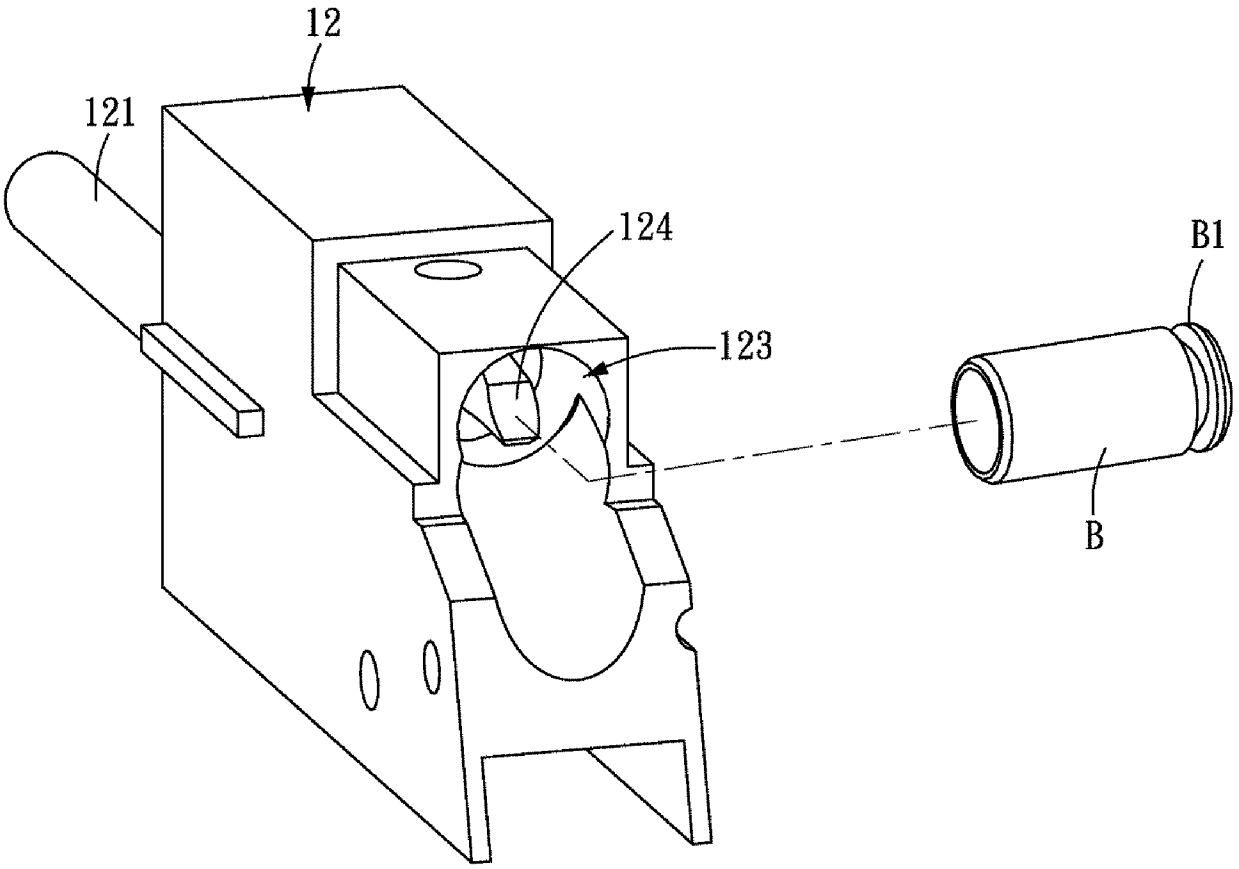
FIG. 10 is an enlarged schematic diagram of a first body in FIG. 2.
Figure 11:
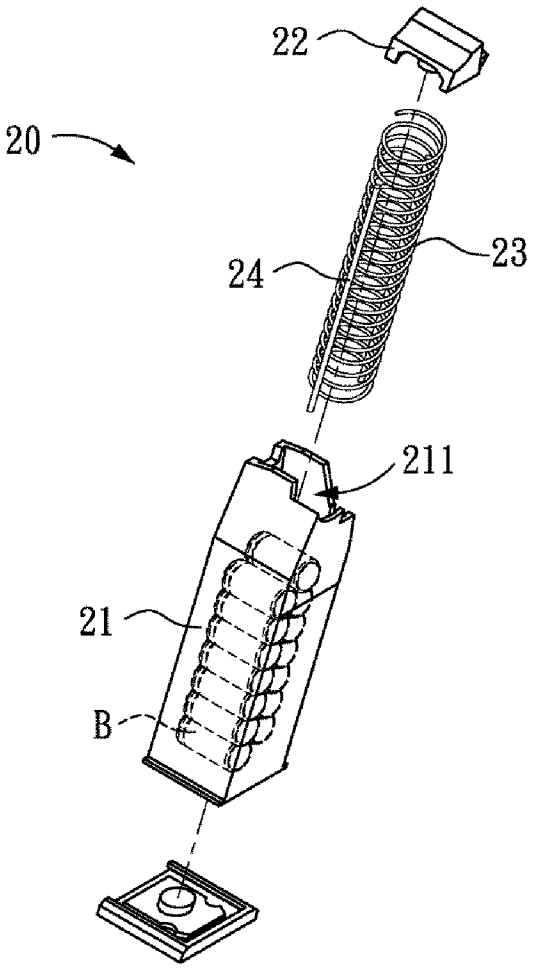
FIG. 11 is an exploded schematic diagram of a magazine assembly in FIG. 2.
Figure 12:
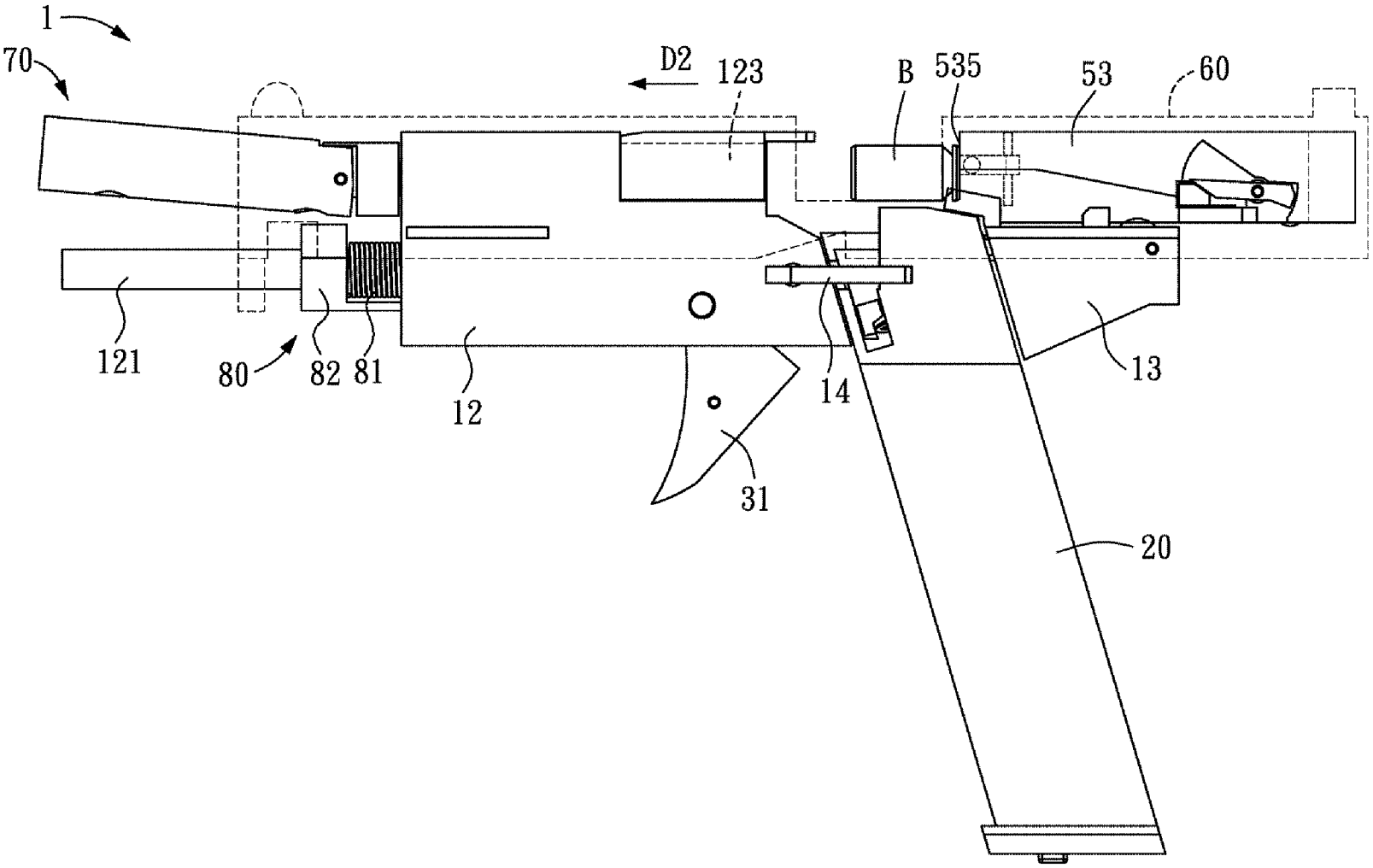
FIG. 12 is a schematic diagram of a blowback slide and a reciprocating slide in FIG. 8 moving towards a second direction.

FIG. 10 shows an enlarged schematic diagram of the first body in FIG. 2. FIG. 11 shows an exploded schematic diagram of the magazine assembly in FIG. 2. FIG. 12 shows a schematic diagram of the blowback slide and the reciprocating slide in FIG. 8 moving towards the second direction.

Refer to FIG. 10, FIG. 11 and FIG. 12. The first body 12 of this embodiment further includes a bullet chamber 123, and the bullet chamber 123 corresponds to a front side 535 of the blowback slide 53. The magazine housing 21 has an opening 211 (refer to FIG. 11 for the opening 211), and the opening 211 is close to the bullet chamber 123. In this embodiment, the cartridge case B is first placed into the magazine 20, and the magazine 20 is installed to the receiver assembly 10. At this point, the opening 211 of the magazine 20 is close to the bullet chamber 123, such that the cartridge case B in the magazine 20 can move through the opening 211 on the upper end to the bullet chamber 123. After the magazine 20 is installed, the user needs to manually pull the reciprocal slide 60 towards the first direction D1. Moreover, the toy gun 1 of this embodiment further has a third unlocking mechanism, which is used for an operation of directly manually pulling the reciprocal 60 by the user.

More specifically, the blowback slide 53 includes a third unlocking protrusion 534, as shown in FIG. 5. The third unlocking portion 534 is located on a bottom side of the blowback slide 53, that is, the side of the blowback slide 53 facing the second body 13. In a locked state, the third unlocking portion 534 and the second press-down portion 1323 are arranged in adjacent. In this embodiment, the second press-down portion 1323 is an arc protrusion, and is a protrusion extending further downward (the direction of the second body 13) from the bottom side of the blowback slide 53. When the user directly pulls the reciprocal slide 60 towards the first direction D1, the reciprocal slide 60 drives the blowback slide 53 to move linearly towards the first direction D1, and the third unlocking portion 534 presses the second press-down portion 1323. The same as the unlocking operation above, the locking member 132 rotates with respect to the pivotal shaft 1321 as an axis toward the second body 13, and at the same time drives the first press-down portion 1322 to enter the second body 13, further unlocking the locking member 132 from the blowback slide 53. Thus, the user can pull the reciprocal slide 60 along with the blowback slide 53 toward the first direction D1.

Next, the user releases the reciprocal slide 60, so that the reciprocal slide 60 drives the blowback slide 53 to move towards the second direction D2, as shown in FIG. 12. At this point, the front side 535 of the blowback slide 53 then pushes the cartridge case B to move towards the second direction D2, until the cartridge case B is moved to be accommodated in the bullet chamber 123. As shown in FIG. 10, preferably, the first body 12 includes a first guide tongue 124, which is located in the bullet chamber 123 and can guide the cartridge case B to enter the bullet chamber 123. More specifically, the cartridge case B is a hollow structure. When the cartridge case B is pushed by the blowback slide 53 and moved to the bullet chamber 123, the guide tongue 124 is inserted into the cartridge case B, so that the cartridge case B can enter the bullet chamber 123 along the guide tongue 124, thereby guiding the cartridge case B to enter the bullet chamber 123. Preferably, the guide tongue 124 can be a slightly flexible member, for example, a plastic member. Moreover, an upper surface of the guide tongue 124 is an arc in shape. Once the guide tongue 124 is inserted into the cartridge case B, the guide tongue 124 can move slightly to further slightly push the cartridge case B upward. Moreover, with the arc surface of the guide tongue 124, the cartridge case B is allowed to smoothly enter the bullet chamber 123, thus achieving an effect of preventing stuck bullets.

In addition, the blowback slide 53 further includes a bullet holder 536. The bullet holder 536 pivots to the blowback slide 53, and one end of the bullet holder 536 protrudes from the front side 535 of the blowback slide 53 to hold the cartridge case B. More specifically, the cartridge case B has an annular groove B1, and a front end of the bullet holder 536 is a hooked structure (as shown in FIG. 6). When the blowback slide 53 moves towards the second direction D2 and comes into contact with the cartridge case B, the hooked structure at the front end of the bullet holder 536 can hold the annular groove B1 of the cartridge case B, as shown in FIG. 3, FIG. 4A and FIG. 7A. Moreover, because the bullet holder 536 pivots to the blowback slide 53, the front end of the bullet holder 536 first slightly dilates outward upon coming into contact with the cartridge case B. The cartridge case B is then held in an inward manner after the hooked structure of the bullet holder 536 comes into the annular groove B1, thus completing the bullet loading action.

After the bullet loading by means of manually pulling the reciprocal slide 60, the user can pull the trigger 31 to cause the blowback slide 53 and the reciprocal slide 60 to move towards the first direction D1, and the cartridge case B is then ejected out of the toy gun 1, achieving a simulation effect of case ejection.

As shown in FIG. 2, FIG. 4B, FIG. 7B and FIG. 8, the second body 13 of this embodiment further includes a case ejection protrusion 134. The case ejection protrusion 134 faces the bullet chamber 123 (referring to FIG. 4B), which means that the case ejection protrusion 134 extends toward the open end of the bullet chamber 123. When the user pulls the trigger 31 and the blowback slide 53 receives the restoring energy of the blowback spring 52 and moves towards the first direction D1, the bullet holder 536 of the blowback slide 53 becomes capable of pulling the cartridge case B from the bullet chamber 123, as shown in FIG. 7B. In other words, the bullet holder 536 holds the cartridge case B and moves backward, so as to pull the cartridge case B out of the bullet chamber 123. Once the cartridge case B moves backward to the position of the case ejection protrusion 134, the case ejection protrusion 134 then presses the cartridge case B and thrusts out the cartridge case B, as shown in FIG. 8. Because the bullet holder 536 pivots to the blowback slide 53, the bullet holder 536 can shift outward and allow the cartridge case B to depart form the bullet holder 536 so as to complete the case ejection action.

As shown in FIG. 1, FIG. 3 and FIG. 8, the reciprocal slide 60 of this embodiment has a case ejection opening 61. When the cartridge case B is pressed by the case ejection protrusion 134, the case ejection opening 61 of the reciprocal slide 60 moves to the position of the case ejection protrusion 134, so that the cartridge case B departing from the bullet holder 536 can be ejected out of the toy gun 1 from the case ejection opening 61.

As shown in FIG. 11, the magazine 20 of this embodiment includes a bullet bearer 22 and a bullet spring 23. One end of the bullet spring 23 connects to the bottom (referring to FIG. 13) of the magazine 20, and the other end connects to the bullet bearer 22. When the cartridge case B is loaded into the magazine 20, the cartridge case B is located on a top surface of the bullet bearer 22. If more cartridge cases 22 are continually loaded, the bearer spring 23 is compressed. When the cartridge case B is ejected to the outside, the bullet spring 23 of the magazine 20 can then push the bullet bearer 22 and the cartridge case B upward. Next, the reciprocal slide 60 and the blowback slide 53 are driven by the reset slide 82 and move towards the second direction D2, as shown in FIG. 12. At this point, the front side 535 of the blowback slide 53 pushes the uppermost cartridge case B into the bullet chamber 123, again completing the bullet loading action. Thus, continuous actions of case ejection and bullet loading can be completed each time the user pulls the trigger 31, until all the cartridge cases B in the magazine 20 are ejected to the outside. In other words, only the first round of bullet loading after installing the magazine 20 is completed by means of pulling the reciprocal slide 60 manually, and the rest can be completed by means of pulling the trigger 31.

Preferably, the magazine 20 of this embodiment further includes at least one support 24. The support 24 is embedded in the magazine housing 21. Two supports 24 are taken as an example in this embodiment, and they are symmetrically embedded in the magazine housing 21. A long axis of the support 24 is parallel to a long axis of the magazine housing 21. In general, the magazine housing 21 is made of plastic. Preferably, the support 24 can be a metal having a better strength than plastic, for example, an iron wire. With the support 24 provided, the overall strength of the magazine housing 21 is reinforced, further preventing interference with the magazine casing 21 when the cartridge case B is loaded in the magazine housing 21, further improving smoothness of bullet loading.

Preferably, the magazine 20 of this embodiment is applicable to a double-row magazine. As shown in FIG. 11, the magazine housing 21 can accommodate double rows of cartridge cases B, and the cartridge cases B are alternately arranged in the magazine housing 21. The magazine housing 21 is a gradually tapered structure toward a top end (one end close to the opening 211), so that the two rows of cartridge cases B can be supplied alternately one after another at a time. In general, bullet jamming is likely caused due to expansion and deformation when a double-row magazine is fully loaded by the cartridge cases B. The magazine 20 of this embodiment includes two supports 24 that are symmetrically in the magazine housing 21. Thus, the overall strength of the magazine housing 21 made of plastic can be reinforced, and expansion or deformation is prevented when filled with the cartridge cases B, further preventing any occurrence of bullet jamming.

Figure 13:
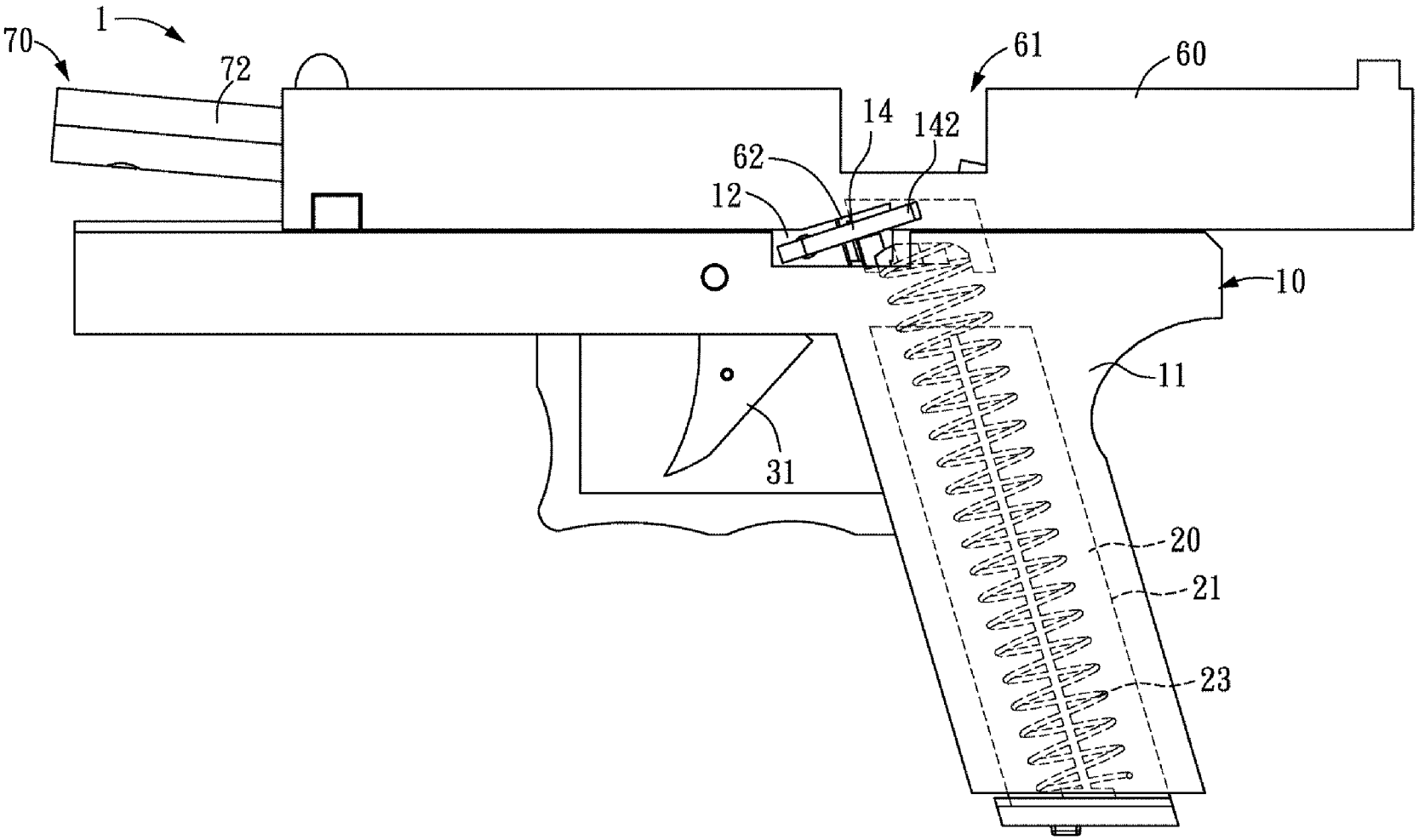
FIG. 13 is a schematic diagram of the toy gun in FIG. 8 in an unloaded idle state.
Figure 14:
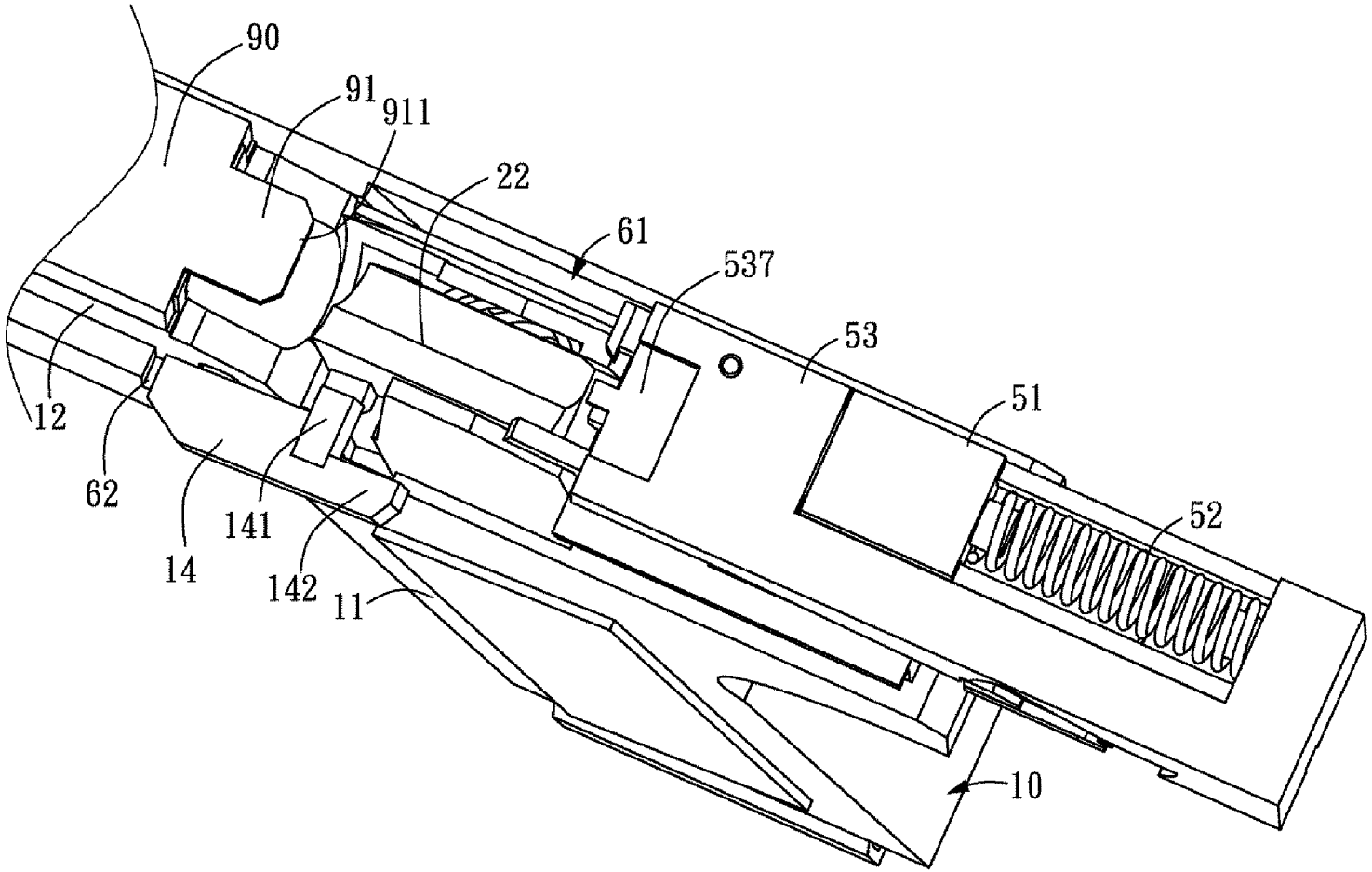
FIG. 14 is a three-dimensional diagram of the toy gun in FIG. 13 from a different viewing angle.

FIG. 13 shows a schematic diagram of the toy gun in FIG. 8 in an unload idle state. FIG. 14 shows a three-dimensional diagram of the toy gun in FIG. 13 from a different viewing angle. Refer to FIG. 13 and FIG. 14. The receiver assembly 10 of this embodiment further includes a reciprocal slide release member 14. The reciprocal slide release member 14 pivots to the first part 12, and a part of the reciprocal slide release member 14 is located at the opening 211 of the magazine 20 (refer to FIG. 11 for the opening 211). More specifically, the reciprocal slide release member 14 has a first protrusion 141 and a second protrusion 142. The first protrusion 141 extends toward the inside of the first body 12, so that a part of the first protrusion 141 can be located at the opening 211 of the magazine 20. The second protrusion 142 is located on the outside of the receiver housing 11. Preferably, the first protrusion 141 and the second protrusion 142 are substantially perpendicular to each other.

When the toy gun 1 is being used, as the states shown in FIG. 4B, FIG. 7B, FIG. 8 and FIG. 12, a long axis of the reciprocal slide release member 14 is parallel to a top edge of the receiver housing 11, and the reciprocal slide release member 14 does not go beyond the receiver housing 11. Thus, the reciprocal slide release member 14 does not affect back and forth movements of the reciprocal slide 60 during shooting. Once all of the cartridge cases B in the magazine 20 have been ejected out of the toy gun 1, the bullet bearer 22 moves to the opening 211. At this point, the bullet bearer 22 pushes the reciprocal slide release member 14, so that the reciprocal slide release member 14 is lifted toward the reciprocal slide 60 to be engaged at the reciprocal slide 60, and this state is usually referred to an unloaded idle state, as shown in FIG. 13 and FIG. 14. Preferably, the reciprocal slide 60 correspondingly includes a groove 62, so that the lifted reciprocal slide release member 14 can be engaged at the groove 62.

Since the reciprocal slide 60 is engaged by the reciprocal slide release member 14, the reciprocal slide 60 is unable to continue moving towards the second direction D2; that is, the reset strokes of the reciprocal slide 60 and the blowback assembly 50 are interrupted, the two do not return to original positions, and the reset spring 81 is still compressed by the reset slide 82. Moreover, as shown in FIG. 10, a part below the first body 12 is hollow. Thus, when the reset slide 82 compresses the reset spring 81, a rear end of the reset slide 82 can also come into contact with a front end of the trigger slide 32, further obstructing the sear slide 32 from resetting towards the second direction D2, such that the sear spring 35 is continuously compressed. Relative positions of the reset slide 82 and the trigger slide 32 can be referred from FIG. 3; however, the state shown in FIG. 3 is a state where neither of the trigger spring 35 and the reset spring 81 is compressed.

After the user replaces the magazine 20 that is refilled with the cartridge cases B, the use can pull the reciprocal slide release member 14 downward so as to release the connection between the reciprocal slide 60 and the reciprocal slide release member 14. At this point, double restoring energy of the reset spring 81 and the trigger spring 35 drive the reciprocal slide 60 and the blowback slide 53 to move towards the second direction D2 (forward). As described above, the front side 535 of the blowback slide 53 at this point can push the (refilled) cartridge cases B into the bullet chamber 123, so as to complete the bulling loading action.

In this embodiment, when the cartridge case B is present in the bullet chamber 123, the cartridge cases B can serve as a limiting structure for the blowback slide 53 and the reciprocal slide 60. As described above, when the blowback slide 53 moves towards the second direction D2 (forward), the cartridge case B can be pushed into the bullet chamber 123. Once the cartridge case B is positioned in the bullet chamber 12, the blowback slide 53 can no longer move forward. Conversely, when the cartridge case B is not present in the bullet chamber 123, the blowback slide 53 can be limited by a limiting element 90 from moving forward.

As shown in FIG. 3 and FIG. 14, the receiver assembly 10 of this embodiment further includes a limiting element 90, which is arranged on an outer side of the bullet chamber 123. Preferably, the limiting element 90 has a limiting protrusion 91. Correspondingly, the blowback slide 53 has a limiting slot 537 facing one side of the first body 12. When the blowback slide 53 is at an original position, the limiting protrusion 91 is accommodated in the limiting slot 537. Thus, while the cartridge case B is not present in the bullet chamber 123, when the blowback slide 53 moves forward to a front end 911 (as shown in FIG. 14) of the limiting protrusion 91 and pushes the bottom of the limiting slot 537, the blowback slide 53 and the reciprocal slide 60 then stop moving forward. In addition, the form of the limiting element 90 corresponds to the case ejection opening 61 of the reciprocal slide 60. When the reciprocal slide 60 is at an original position, the limiting element 90 is located on an inner side of the case ejection opening 61, also achieving effects of providing the toy gun 1 with a more complete appearance and preventing from directly seeing internal structures of the toy gun 1.

Figure 15A:
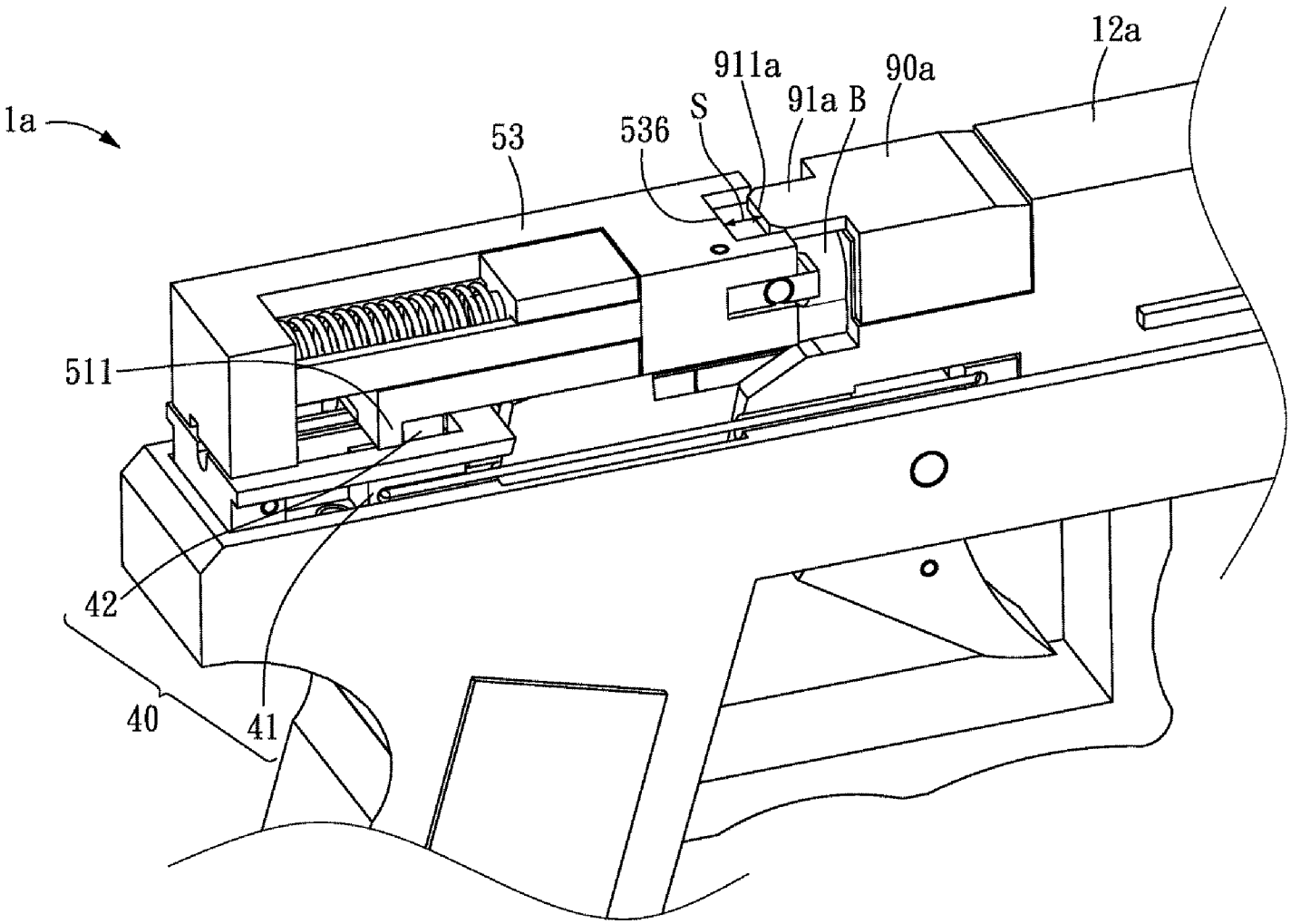
FIG. 15A is a schematic diagram of a toy gun according to another embodiment of the present invention.
Figure 15B:
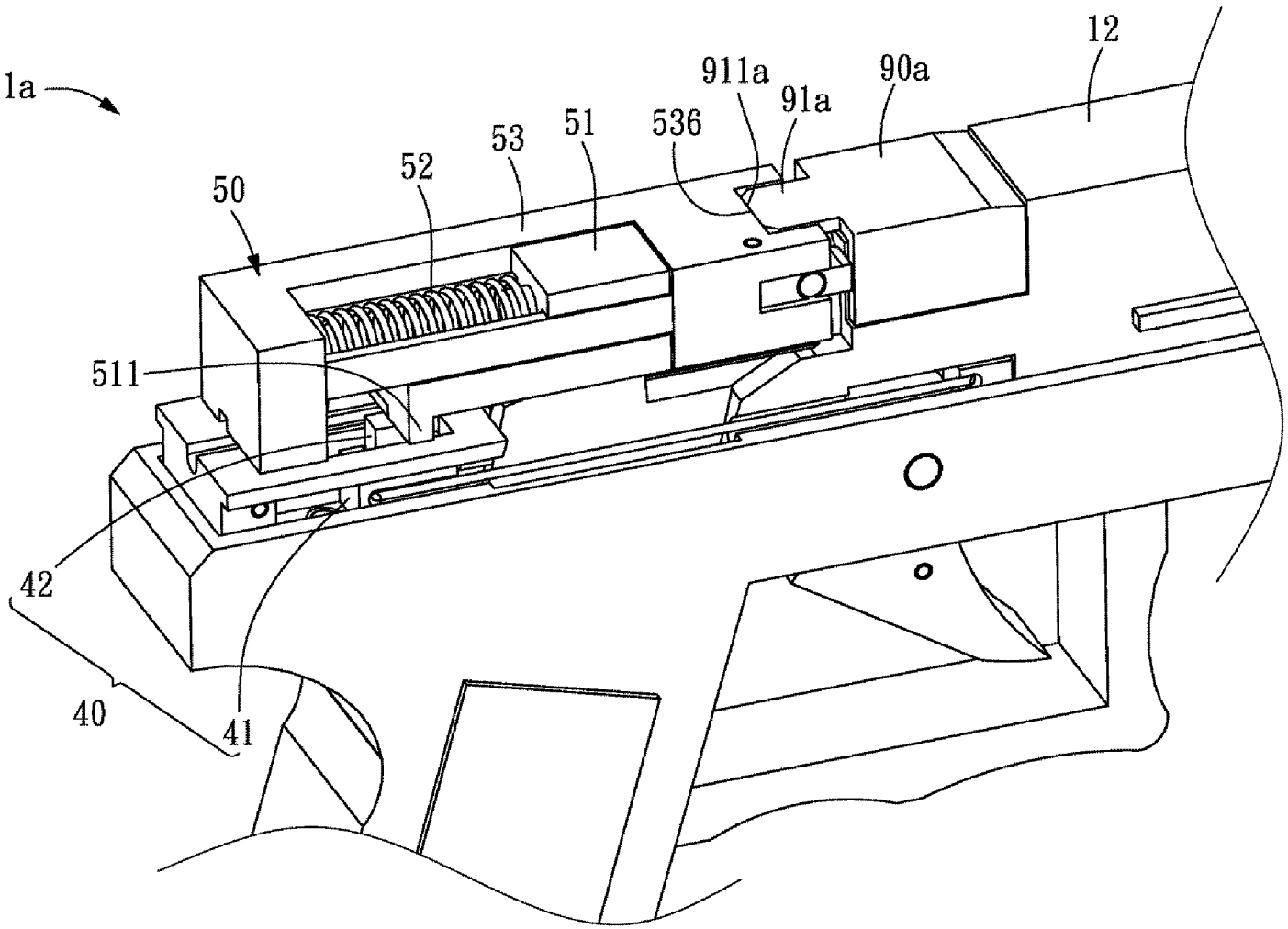
FIG. 15B is a schematic diagram of the toy gun in FIG. 15A in an unloaded state.

FIG. 15A shows a schematic diagram of a toy gun according to another embodiment of the present invention. FIG. 15B shows a schematic diagram of the toy gun in FIG. 15A that is unloaded with bullets. Refer to FIG. 15A and FIG. 15B. It should be noted that, a toy gun 1*a* of this embodiment differs from the toy gun 1 of the foregoing embodiment in respects of a length of the limiting member 90*a* and a length of an outer side of the bullet chamber of a first body 12*a* (refer to the foregoing drawings for the bullet chamber), while the remaining elements are the same as those of the foregoing embodiments and thus the same denotation numerals and symbols are inherited. In this embodiment, lengths of a limiting protrusion 91*a* and the cartridge case B can be used to design a mechanism for rendering pulling of the trigger 31 invalid when the cartridge case B is not present in the bullet chamber 123 (that is, when unloaded). More specifically, when the cartridge case B is present in the bullet chamber 123 and the blowback slide 53 is completely reset forward, a gap S exist between a front end of the limiting element 91*a* and the bottom of the limiting slot 537 (as shown in FIG. 15A). It should be noted that, the front end of the limiting protrusion 91*a* refers to the end of the limiting protrusion 91*a* close to the blowback slide 53. Meanwhile, the sear assembly 40 is also completely reset, and the sear 42 is located on an inner side of the stop portion 511 (that is, the front of the drawing). Thus, while the cartridge case B is not present in the bullet chamber 123, as described previously, when the trigger 31 is pulled or in an unloaded idle state, the sear 42 sinks into the sear base 41 and does not interfere with the blowback slide 53. At this point, being free from limiting and blocking of the cartridge case B, the blowback slide 53 is allowed to continue moving towards the second direction D2 by a distance S, until the bottom of the limiting slot 537 comes into contact with a front end 911*a* of the limiting protrusion 91, as shown in FIG. 15B. In other words, the blowback slide 53 further moves forward by the distance of the gap S, further causing the energy-storing slide 51 to also move forward by the distance of the gap S. At this point, the sear 42 of the sear assembly 40 is located on an outer side of the energy-storing slide 51, as shown in FIG. 15B. In this state, even if the user pulls the trigger 31, the sear assembly 40 is incapable of moving along with the blowback assembly 50. In other words, the action of the user pulling the trigger 31 in this state is invalid.

In this embodiment, the barrel assembly 70 is arranged on the front sidewall 122 of the first body 12, and is located above the elongated portion 121. The barrel assembly 70 includes a fixing member 71 and a barrel member 72. As shown in FIG. 3, the fixing member 71 connects to the front sidewall 122 of the first body 12. The barrel member 72 pivots to the fixing member 71, such that the barrel member 72 can shift upward relative to the fixing member 71, as shown in FIG. 8.

As shown in FIG. 3 and FIG. 8, the reset assembly 80 further includes a first magnet 83, and the first magnet 83 is arranged at the reset slide 82. Preferably, the first magnet 83 can be close to the reset slide 82 so as to face the barrel assembly 70. Correspondingly, the barrel assembly 70 includes a second magnet 73, and the second magnet 73 is arranged on a lower surface of the barrel member 72 and adjacent to the fixing member 71. The first magnet 83 and the second magnet 73 have the same polarity (for example, both being the S-polarity or both being N-polarity), and so a repulsive force is generated when the two approach each other. When the reciprocal slide 60 drives the reset slide 82 to move towards the first direction D1 and when the reset slide 82 has moved to the end (as shown in FIG. 8), the position of the reset slide 82 corresponds to one end of the barrel member 72 close to the fixing member 71, and the first magnet 83 is close to the second magnet 73. Due to repulsion of the same polarity of the first magnet 83 and the second magnet 73, the barrel member 72 is caused to shift upward, so as to achieve the simulation effect of slightly lifting the barrel member 72 when the toy gun 1 is fired.

Preferably, the barrel assembly 70 further includes another magnet, which is referred to as a third magnet 74 herein. The third magnet 74 is similarly arranged on the lower surface of the barrel member 72, but is closer to a front end of the barrel member 72. For example, when the reset slide 82 is located at an original position, positions of the first magnet 83 and the third magnet 74 correspond to each other. Moreover, the first magnet 83 and the third magnet 74 have opposite polarities to generate a force of attraction toward each other. Thus, when the reset slide 82 is driven by the restoring energy of the reset spring 81 to move towards the second direction D2, with the force of attraction of opposite polarities of the first magnet 82 and the third magnet 73, the barrel member 72 is restored to an original position parallel to the elongated portion 121.

Figure 16:
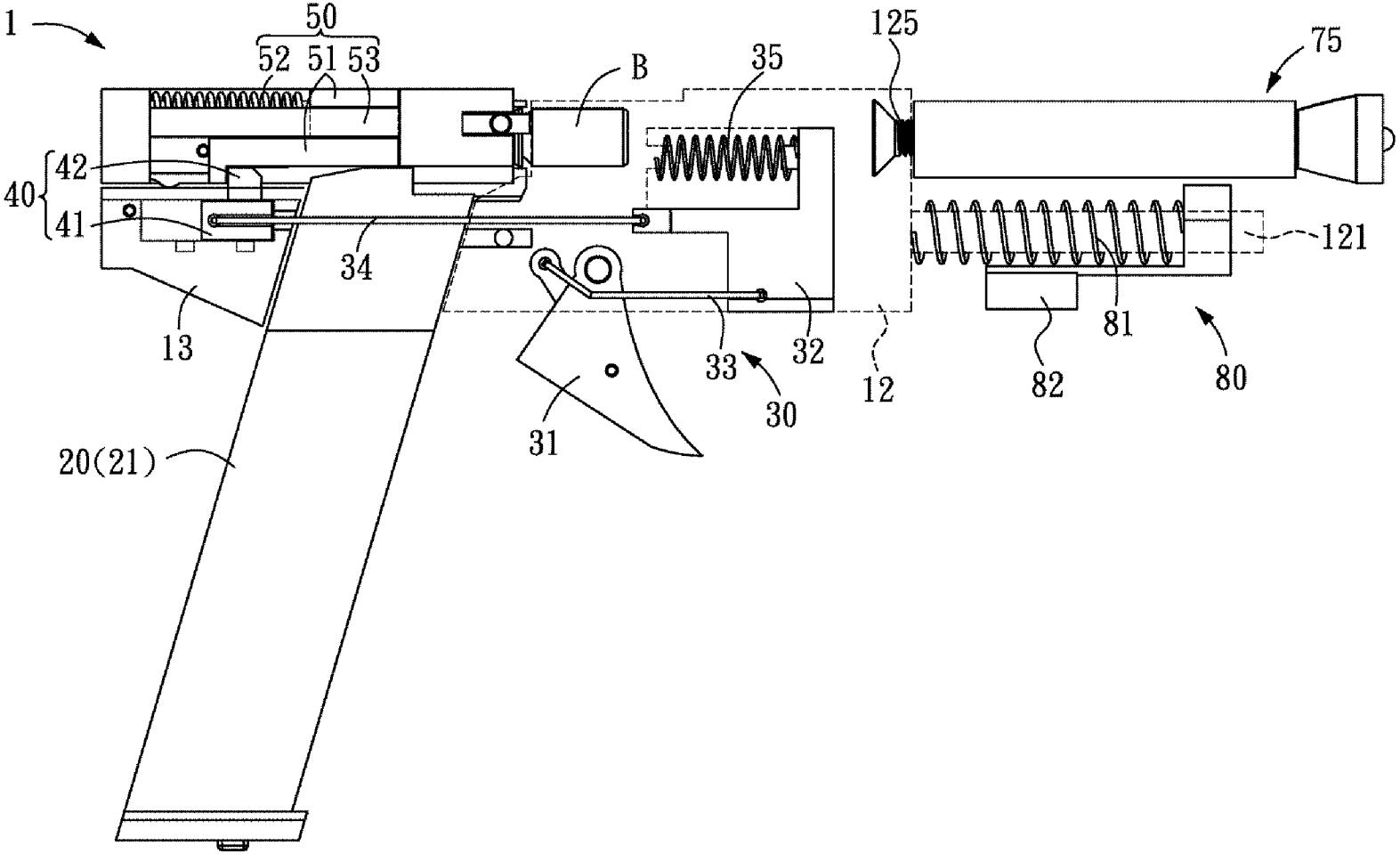
FIG. 16 is a schematic diagram of a laser barrel used in substitution for a barrel assembly in FIG. 3.

Preferably, the barrel assembly 70 detachably connects to the first body 12. As shown in FIG. 3, the front sidewall 122 of the first body 12 can include a threaded portion 125. One end of the fixing member 71 can have a matching thread to further screw at the threaded portion 125 of the first body 12, thereby allowing the barrel assembly 70 to detachably connect on the first body 12. With the detachable design, the barrel assembly 70 can be replaced by different types of barrels for a user to choose different types of barrels according to requirements. For example, the toy gun 1 can further include a laser barrel 75, as shown in FIG. 16. FIG. 16 shows a schematic diagram of a laser barrel used in substitution for the barrel assembly in FIG. 3. One end of the laser barrel can also have a thread matching the threaded portion 125 so as to screw to the threaded portion 125 of the first body 125, thereby substituting for the barrel assembly 70.

In conclusion, a toy gun according to the present invention includes a receiver assembly, a magazine, a trigger assembly, a sear assembly, a blowback assembly and a reciprocating slide. The trigger assembly includes a trigger, a trigger slide, a first connecting member and a second connecting member. The blowback assembly includes a energy-storing slide, a blowback spring and a blowback slide. The energy-storing slide is engaged with the sear assembly. Two opposite ends of the first connecting member connect to the trigger and the trigger slide, respectively, and two opposite ends of the second connecting member connect to the trigger slide and the sear assembly, respectively. The sear assembly is further engaged with the energy-storing slide. When the trigger rotates, the first connecting member is capable of pulling the trigger slide to move linearly, and driving the second connecting member, the sear assembly and the energy-storing slide to move linearly towards the same direction. Moreover, the energy-storing slide compresses the blowback spring, and the blowback slide receives a restoring energy of the blowback spring to drive the reciprocating slide to move backward. Thus, the toy gun of the present invention achieves a simulation effect of rotating actions of a trigger, as well as a simulation effect of blowback actions of a reciprocating slide.

It should be noted that, the embodiments given above are examples for better illustrate the present invention, and the scope of claims asserted by the present invention are not to be limited by the embodiments above but are to be accorded with the appended claims.

What is claimed is:

1. A gun, comprising:

a receiver assembly;

a magazine detachably installed on the receiver assembly;

a trigger assembly arranged in the receiver assembly and located on a front side of the magazine, the trigger assembly comprising:

a trigger pivoted to the receiver assembly;

a trigger slide;

a first connecting member having two opposite ends connected to the trigger and the trigger slide, respectively;

a second connecting member having one end connected to the trigger slide;

a sear assembly accommodated in the receiver assembly and located on a rear side of the magazine, the sear assembly connected to one other end of the second connecting member;

a blowback assembly comprising:

a energy-storing slide engaged with the sear assembly;

a blowback spring having one end close to the magazine abutting against the energy-storing slide; and a blowback slide in which the energy-storing slide and the blowback spring are accommodated; and a reciprocating slide sleeved on the receiver assembly and connected with the blowback slide;

when the trigger rotates towards a first direction, the first connecting member pulls the trigger slide to move linearly towards the first direction, the second connecting member, the sear assembly and the energy-storing slide sequentially move linearly towards the first direction, the energy-storing slide compresses the blowback spring, and the blowback slide receives a restoring energy of the blowback spring and drives the reciprocal slide to move towards the first direction.

2. The gun as claimed in claim 1, wherein the receiver assembly comprises a receiver housing, a first body and a second body; the first body and the second body are accommodated in the receiver housing, the first body is located on the front side of the magazine, the second body is located on the rear side of the magazine, and the blowback assembly is located on an upper side of the second body.

3. The gun as claimed in claim 2, wherein the trigger further comprises a link rod located near one side of the magazine, and two opposite ends of the first connecting member connect to the link rod and the trigger slide, respectively.

4. The gun as claimed in claim 2, wherein the blowback slide comprises a locking slot, and the second body further comprises a locking member; in a locked state, the locking member protrudes from the second body and is engaged in the locking slot; in an unlocked state, the locking member is accommodated in the second body and releases the blowback slide.

5. The gun as claimed in claim 4, wherein the energy-storing slide has at least one unlocking protrusion formed by extending from one sidewall of the energy-storing slide close to the locking member; when the energy-storing slide moves towards the first direction, the unlocking member directly or indirectly presses the locking member.

6. The gun as claimed in claim 5, wherein the blowback slide has an unlocking lever; the unlocking member has a first end and a second end that are opposite, the first end is adjacent to the unlocking protrusion, and the second end is adjacent to the locking member; when the energy-storing slide moves towards the first direction, the unlocking protrusion lifts the first end of the unlocking lever, and the second end presses the locking member.

7. The gun as claimed in claim 6, wherein the locking member pivots to the second body, the locking member comprises a first press-down portion and a second press-down portion, the energy-storing slide has two of the unlocking protrusions which are a first unlocking protrusion and a second unlocking protrusion, respectively, the first end of the unlocking lever is adjacent to the first unlocking protrusion, the second end of the unlocking lever is adjacent to the first press-down portion, and the second unlocking protrusion corresponds to the second press-down portion.

8. The gun as claimed in claim 7, wherein the blowback slide has a third unlocking protrusion located on a bottom side of the blowback slide; in the locked state, the third unlocking protrusion and the second press-down portion are adjacently arranged.

9. The gun as claimed claim 7, wherein the blowback slide comprises a bullet holder pivoted to the blowback slide, and one end of the bullet holder protrudes from the front side of the blowback slide.

10. The gun as claimed in claim 2, wherein the first body comprises an elongated portion located on a front sidewall of the first body, the gun further comprises:

a reset assembly comprising a reset spring and a reset slide, the reset spring sleeved on the elongated portion, the reset slide arranged on one side of the reset spring opposite to the front sidewall, and the reset slide connected to the reciprocal slide.

11. The gun as claimed in claim 10, wherein when the reset slide moves along with the reciprocal slide towards the first direction, the reset spring is compressed by the reset slide, and then a restoring energy of the reset spring drives the reset slide and the reciprocal slide to move towards a second direction, wherein the second direction is opposite to the first direction.

12. The gun as claimed in claim 11, wherein the reset assembly further comprises a first magnet arranged on the reset slide, and the gun further comprises:

a barrel assembly arranged on the front sidewall of the first body and located above the elongated portion, the barrel assembly comprising:

a fixing member connected to the front sidewall of the first body;

a barrel member pivoted to the fixing member; and a second magnet, arranged on a lower surface of the barrel member and adjacent to the fixing member, wherein the first magnet and the second magnet have a same polarity.

13. The gun as claimed in claim 2, wherein the first body comprises a guide tongue and a bullet chamber, and the guide tongue is located in the bullet chamber.

14. The gun as claimed in claim 9, wherein the first body comprises a guide tongue and a bullet chamber, and the guide tongue is located in the bullet chamber; the second body comprises a case ejection protrusion, and the case ejection protrusion faces the bullet chamber; when the blowback slide receives the restoring energy of the blowback spring and moves towards the first direction, the bullet holder pulls out a cartridge case from the bullet chamber, and the case ejection protrusion thrusts the cartridge case to cause the cartridge case to depart form the bullet holder.

15. The gun as claimed in claim 2, wherein the receiver assembly further comprises a reciprocal slide release member, the magazine has an opening and a bullet bearer, the reciprocal slide release member pivots to the first body, and a part of the reciprocal slide release member is located at an opening of the magazine; when the bullet bearer moves to the opening, the bullet bearer presses the reciprocal slide release member such that the reciprocal slide release member engages with the reciprocal slide.

16. The gun as claimed in claim 2, wherein the trigger assembly further comprises a trigger spring arranged in the first body and has one end abutting against the trigger slide; when the trigger receives a force and rotates towards the first direction, the trigger spring is compressed; when the trigger stops receiving the force, the trigger slide is pushed by the restoring energy of the trigger spring and resets to an original position, and the trigger slide pulls the first connecting member, the second connecting member and the trigger to reset to original positions.

17. The gun as claimed in claim 2, wherein the sear assembly comprises a sear base and a sear, the sear is arranged on the sear base and protrudes from the sear base, the sear base connects to one other end of the second connecting member, and the energy-storing slide engages with the sear.

18. A gun, comprising:

a receiver assembly comprising:

a first body; and a second body;

a sear assembly movably arranged on the second body;

a trigger assembly accommodated in the receiver assembly and being partially rotatable relative to the receiver assembly, the trigger assembly connecting to the first body and the sear assembly;

a reciprocating slide connected to the receiver assembly and being movable relative to the receiver assembly;

a blowback assembly connected to the sear assembly and the reciprocal slide; and a reset assembly arranged on the first body and connected to the reciprocal slide;

wherein when the trigger assembly partially rotates relative to the receiver assembly, the trigger assembly is capable of driving the sear assembly to move the blowback assembly, such that the blowback assembly provides a force for the reciprocating slide to move towards a first direction, the reciprocating slide drives the reset assembly to move towards the first direction, and the reset assembly provides a force for the reciprocating slide to move towards a second direction.

19. The gun as claimed in claim 18, wherein the trigger assembly comprises:

a trigger pivoted to the receiver assembly;

a trigger slide;

a first connecting member having two opposite ends connected to the trigger and the trigger slide, respectively;

a second connecting member having one end connected to the trigger slide;

wherein the blowback assembly comprises:

a energy-storing slide engaged with the sear assembly;

a blowback spring having one end abutting against the energy-storing slide; and a blowback slide in which the energy-storing slide and the blowback spring are accommodated;

wherein when the trigger receives an external force in a first direction and rotates pivotally relative to the receiver assembly, the first connecting member pulls the trigger slide to move linearly towards the first direction, the second connecting member, the sear assembly and the energy-storing slide move linearly towards the first direction, the energy-storing slide compresses the blowback spring, and the blowback slide receives a restoring energy of the blowback spring and moves towards the first direction.

20. The gun as claimed in claim 19, wherein the trigger further comprises a link rod, and two opposite ends of the first connecting member connect to the link rod and the trigger slide, respectively.

* * * * *